US012325571B2

(12) United States Patent
Palumbo et al.

(10) Patent No.: US 12,325,571 B2
(45) Date of Patent: Jun. 10, 2025

(54) HEAT SHRINK APPARATUS AND DEVICE FOR PACKAGING, AND PACKAGING LINE AND PROCESS USING SAID HEAT SHRINK APPARATUS AND DEVICE

(71) Applicant: Cryovac, LLC, Charlotte, NC (US)

(72) Inventors: Riccardo Palumbo, Arona (IT); Giulio Benedetti, Solbiate Arno (IT); Silvia Bottini, Lissone (IT); Stefan Landolt, Obernau (CH); Peter Thurig, Eich (CH)

(73) Assignee: Cryovac, LLC, Charlotte, NC (US)

( * ) Notice: Subject to any disclaimer, the term of this patent is extended or adjusted under 35 U.S.C. 154(b) by 0 days.

(21) Appl. No.: 18/568,026

(22) PCT Filed: Jan. 27, 2022

(86) PCT No.: PCT/EP2022/051960
§ 371 (c)(1),
(2) Date: Dec. 7, 2023

(87) PCT Pub. No.: WO2022/258230
PCT Pub. Date: Dec. 15, 2022

(65) Prior Publication Data

US 2024/0270428 A1 Aug. 15, 2024

(30) Foreign Application Priority Data

Jun. 9, 2021 (EP) ..... 21178437

(51) Int. Cl.

| | |
|---|---|
| ***B65B 53/02*** | (2006.01) |
| ***B65B 43/04*** | (2006.01) |
| ***B65B 51/18*** | (2006.01) |
| ***B65B 57/00*** | (2006.01) |
| ***B65D 75/00*** | (2006.01) |
| ***B65D 75/32*** | (2006.01) |
| ***B65D 75/58*** | (2006.01) |

(52) U.S. Cl.
CPC ..... *B65D 75/5805* (2013.01); *B65B 43/04* (2013.01); *B65B 51/18* (2013.01); *B65B 53/02* (2013.01); *B65B 57/00* (2013.01); *B65D 75/002* (2013.01); *B65D 75/326* (2013.01)

(58) Field of Classification Search
None
See application file for complete search history.

(56) References Cited

U.S. PATENT DOCUMENTS 3,552,088 A * 1/1971 Niwa ..... B65B 51/18 53/74
3,863,837 A 2/1975 Spiegel et al.
(Continued)

FOREIGN PATENT DOCUMENTS

EP 2805821 A1 11/2014
WO WO-2020094267 A1 * 5/2020 ..... B29C 65/18

*Primary Examiner* — Tanzim Imam
(74) *Attorney, Agent, or Firm* — Jon M. Isaacson

(57) ABSTRACT

A package comprises a plastic bag delimiting a seat sealingly housing a product. The plastic bag has plastic film walls (4) and at least one sealing band connecting together opposed wall portions of the plastic film walls at a connecting zone. A tab is coupled with the connecting zone of the plastic bag. The tab includes an easy opening feature at one or more of its perimeter edges.

20 Claims, 8 Drawing Sheets

(56) References Cited

U.S. PATENT DOCUMENTS

| | | | | |
|---|---|---|---|---|
| 4,219,988 | A * | 9/1980 | Shanklin | B29C 66/4322 53/374.6 |
| 6,106,935 | A | 8/2000 | Lambert et al. | |
| 6,221,470 | B1 | 4/2001 | Ciocca et al. | |
| 6,299,984 | B1 | 10/2001 | Forloni | |
| 6,602,455 | B1 | 8/2003 | Forloni | |
| 2004/0128957 | A1 * | 7/2004 | Guzman | B29C 65/7894 53/374.6 |
| 2006/0107622 | A1 * | 5/2006 | James | B29C 66/836 53/374.5 |
| 2009/0049803 | A1 * | 2/2009 | Limousin | B29C 65/749 53/203 |
| 2012/0233965 | A1 | 9/2012 | Riccio et al. | |
| 2022/0040955 | A1 * | 2/2022 | Benedetti | B65B 51/146 |

* cited by examiner

FIG.5
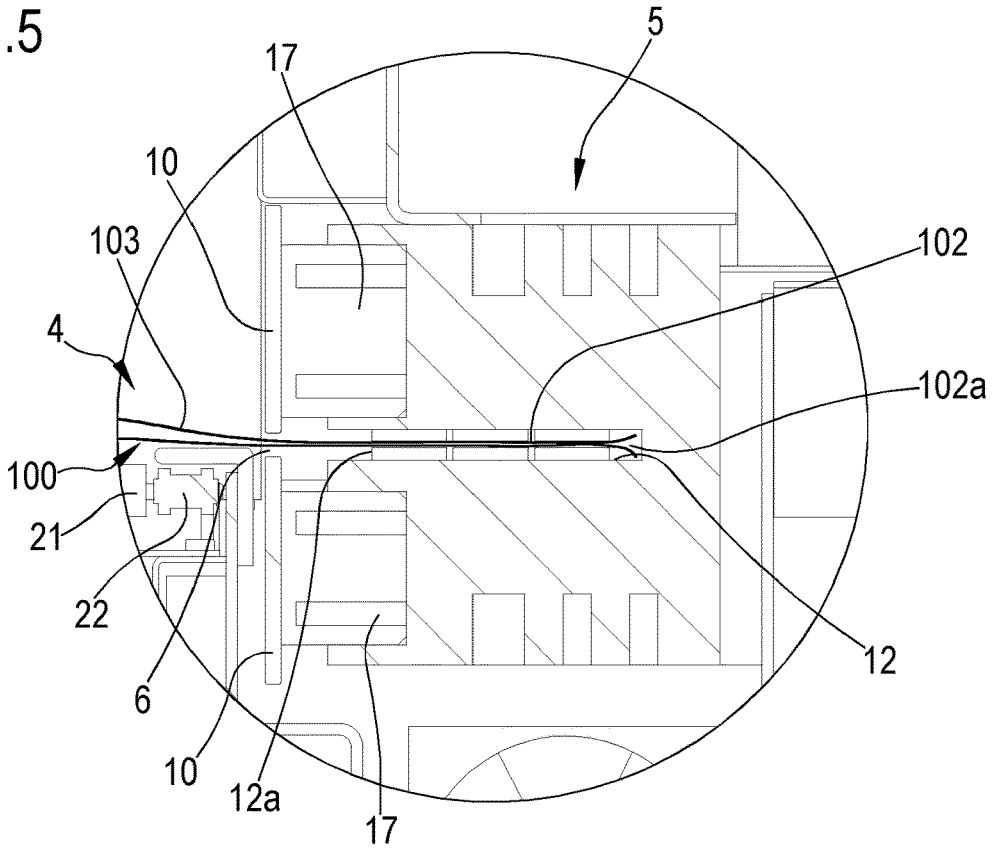
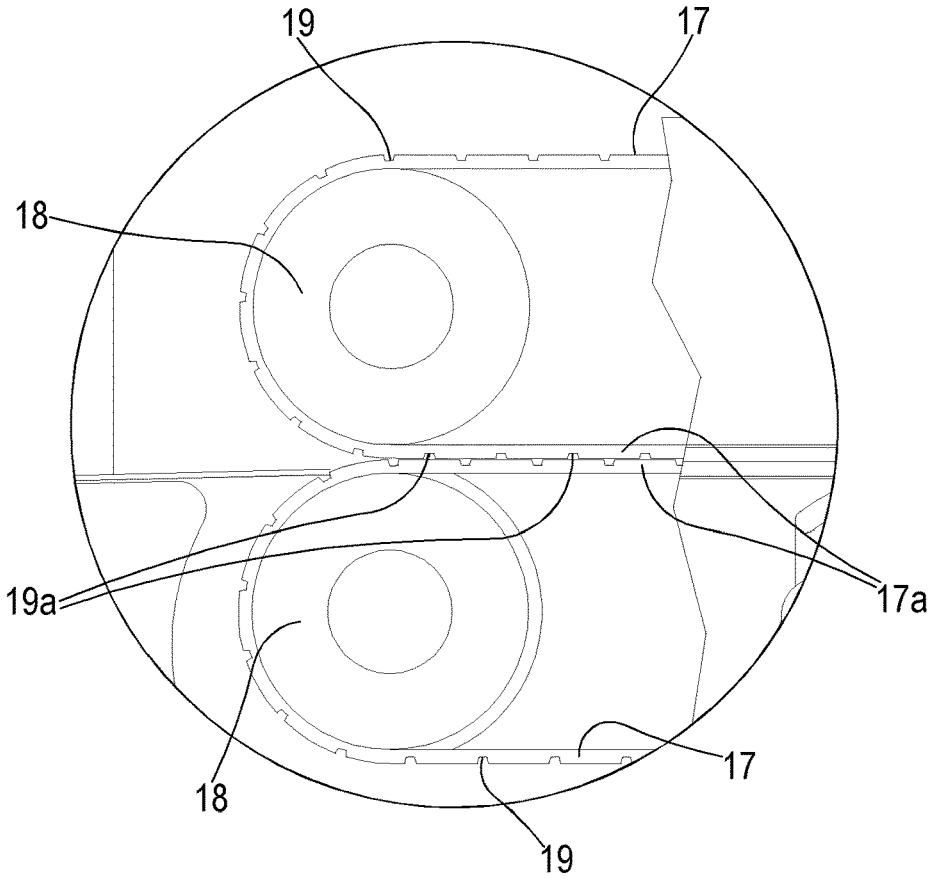
FIG.6

HEAT SHRINK APPARATUS AND DEVICE FOR PACKAGING, AND PACKAGING LINE AND PROCESS USING SAID HEAT SHRINK APPARATUS AND DEVICE

FIELD OF THE INVENTION

The present invention relates to a heat shrink apparatus and/or to a heat shrink device for packaging. The invention also relates to heat shrink process used in the ambit of packaging. The heat shrink apparatus, device and process described and claimed herein may be used for heat shrinking packaging bags or pouches or other containers made from or comprising heat shrinkable plastic film material; the containers, such as bags or pouches, are destined to contain products, for example of a food type. The invention also relates to a packaging process and to a packaging line using heat shrinkable plastic film material. In particular the packaging line and the packaging process may use the mentioned shrink apparatus and/or the mentioned heat shrink device to manufacture packages made from or comprising heat shrinkable plastic film material. The invention may have application to form packages wherein most of the gas inside the packages has been evacuated. In a possible variant the invention may find application in vacuum packaging.

BACKGROUND ART

In the food packaging field, plastic films are used to form packages. The plastic film wraps and protects the product also allowing the consumer to see the product and thus visually assess product features such as size, shape, and quality of the product. Plastic packages used in the packaging of food often include containers in the form of a bag or pouch of plastic material into which the product, such as a food product, is inserted. The plastic container is then sealed.

In the above context, heat shrinkable plastic film materials have been widely used for their ability to provide a resistant enclosure for the product, while typically reducing the quantity of plastic material necessary to form the package and thus reducing waste material when the package needs to be disposed of after aperture.

On the other hand, known packaging processes and systems used to wrap products using heat shrinkable plastic film material often form packages of scarce aesthetic properties and/or not susceptible of receiving prints.

Furthermore, known processes and systems using heat shrinkable material are often complex to implement and require additional operations, such as piercing and then sealing of the processed package, in order to evacuate gas possibly contained in the package during shrink.

Moreover, known shrink techniques are often using water to shrink packages, which inherently requires very complex and cumbersome apparatus.

In addition, known shrink apparatus and processes are unable to shrink selected portions of the processed packages.

Additionally, known systems and processes, particularly those using shrinkable plastic wraps, do not provide efficient solutions for forming easy opening features on the package, thus resulting either in complex solutions or in the production of packages, which may be difficult to open.

Finally, known systems and processes, particularly those using shrinkable plastic wraps, do not provide efficient solutions for automatizing the application of labels to the package.

OBJECT OF THE INVENTION

The object of the present invention is to solve the one or more of the drawbacks and/or limitations of the above prior art. Auxiliary objects of the invention are indicated below.

An object of the invention is to provide a new heat shrink apparatus and/or a new heat shrink device and related process of simplified design, which may be used to efficiently shrink the film of the packages under formation, such as bags or pouches or other containers.

A further object of the invention is to provide a new heat shrink apparatus and/or a new heat shrink device and/or a new heat shrink process capable of efficiently shrinking the packages under formation, avoiding the need of supplementary operations such as piercing of the film.

Another object is that of providing a new heat shrink apparatus and/or a new heat shrink device and/or a new hat shrink process adapted to treat and heat shrink selected portions of a given package.

An additional object of the invention is that of rendering available a new heat shrink apparatus and/or a new heat shrink device and/or a new heat shrink process capable of efficiently evacuate at least part of the gas from inside the processed container.

A further object of the invention is to provide a new heat shrink apparatus and/or a new heat shrink device and/or a new heat shrink process which may be combined with an apparatus/process for vacuumizing the packages under formation, resulting a lean packaging line.

Another object of the invention is a packaging line and a packaging process implementing the new shrink apparatus and/or the new heat shrink device and process in an efficient manner.

Furthermore, it is an object offering a packaging line and process which may be able to form packages, for example in the form of a plastic bag or pouch, using a reduced quantity of plastic, yet guaranteeing and efficient and robust packaging.

Another object of the invention is a packaging line and process able to form packages of simple and cost-effective structure.

An additional object is that of offering is a packaging line and process able to form packages of improved aesthetic properties and provided with substantially smooth surfaces suitable for carrying prints, drawings, images and the like.

Furthermore, an ancillary object is that of offering a packaging line and process where application of labels is facilitated and automatized.

Finally, a further ancillary object is that of offering a packaging line and process configured for forming an easy opening feature on the package.

SUMMARY

One or more of the above objects are substantially achieved by a heat shrink apparatus, by a heat shrink device and/or by a heat shrink process according to any one of the corresponding claims herewith enclosed. One or more of the above objects are also attained by a packaging line and packaging process according to one or more of the accompanying claims.

Aspects of the invention are disclosed below.

A 1$^{st}$ aspect concerns a heat shrink apparatus configured for processing containers of the type made from or comprising heat shrinkable plastic film, the containers having a main portion where a product is housed, a terminal portion having at least one aperture allowing gas evacuation from the container, and an intermediate portion connecting the main portion and the terminal portion, wherein the shrink apparatus comprises:

an inlet for receiving containers to be processed, an outlet for delivering processed containers, a heat treatment zone between the inlet and the outlet, the heat treatment zone being configured to heat shrink the main portion of processed containers, a heat protected zone extending adjacent to the heat treatment zone and configured for receiving the terminal portion of each container.

In a $2^{nd}$ aspect according to the $1^{st}$ aspect the heat protected zone is connected to the heat treatment zone via one or more openings extending between the heat treatment zone and the heat protected zone.

In a $3^{rd}$ aspect according to the $2^{nd}$ aspect the one or more openings comprise a longitudinal opening extending along the heat treatment zone and configured for receiving at least the intermediate portion of each processed container, such that, during operation of the heat shrink apparatus, the main portion of each processed container is received in the heat treatment zone, while the terminal portion of each processed container remains outside the heat treatment zone with the intermediate portion of each container passing through said longitudinal opening; or wherein the one or more openings comprise plurality of discrete openings formed along the heat treatment zone and each configured for receiving at least the intermediate portion of a respective processed container, such that, during operation of the heat shrink apparatus, the main portion of each processed container is received in the heat treatment zone, while the terminal portion of each processed container remains outside the heat treatment zone with the intermediate portion of each container passing through a respective discrete opening.

In a $4^{th}$ aspect according to any one of the preceding aspects the apparatus is configured to keep the heat treatment zone at a shrink temperature and to keep the heat protected zone at a temperature below the shrink temperature, optionally at a temperature at least 30° C. below said shrink temperature, more optionally at a temperature at least 50° C. below the shrink temperature.

In a $5^{th}$ aspect according to any one of the preceding aspects the heat treatment zone comprises at least one heater which, during operation of the apparatus, it is configured to maintain said heat treatment zone at a/the shrink temperature, which is above 130° C., optionally comprised between 130° C. and 180° C.

In a $6^{th}$ aspect according to any one of the preceding aspects the heat treatment zone comprises a plurality of independently controllable heaters, optionally from 2 to 5 independently controllable heaters, distributed along the heat treatment zone and defining a corresponding plurality of independently heat controllable consecutive longitudinal sections.

In a $7^{th}$ aspect according to the $5^{th}$ or $6^{th}$ aspect the heat treatment zone comprises one or more temperature sensors and a control unit communicatively connected with the one or more temperature sensors and with the heater or heaters, wherein the control unit is configured to:

receive temperature signals from each of said one or more temperature sensors, and control the heater or heaters based on said one or more temperature signals and on one or more reference values.

In an $8^{th}$ aspect according to $5^{th}$ or $6^{th}$ or $7^{th}$ aspect the heater comprises a heat source and a fan blowing air towards the heat source.

In a sub aspect of the present aspect the/each heater is configured to direct hot hair in the heat treatment zone, for example via appropriate channels leading to nozzles distributed on a top portion and on one or more sides of the heat treatment zone to thereby direct hot air towards the processed containers both from above and from one or more sides.

In a $9^{th}$ aspect according to any one of the preceding aspects the heat protected zone, during operation of the apparatus, is configured to be kept at a temperature below 100° C., in particular below 90° C.

In a $10^{th}$ aspect according to any one of the preceding aspects one or more heat insulators are positioned at a periphery of the heat treatment zone, and wherein said heat insulators include at least one heat insulating wall interposed between the heat protected zone and the heat treatment zone.

In a sub aspect of the present aspect the at least one heat insulating wall interposed between the heat protected zone and the heat treatment zone delimits the opening(s).

In a $11^{th}$ aspect according to any one of the preceding aspects the heat protected zone comprises a cooling structure defining an elongated seat, optionally in the form of an elongated flat channel, configured for receiving the terminal portions of each container and having a proximal side ending at said one or more longitudinal openings.

In an optional aspect according to the $11^{th}$ and $10^{th}$ aspect the heat insulating wall is interposed between the cooling structure and the heat treatment zone.

In a $12^{th}$ aspect according to the preceding aspect the heat protected zone comprises at least one active cooler which, during operation of the apparatus, is configured to act on the cooling structure to keep the elongated seat of the heat protected zone at a temperature at least 30° C. below said shrink temperature, more optionally at a temperature at least 50° C. below the shrink temperature;

optionally the heat protecting structure comprising a plurality of coolers, more optionally from 2 to 5 coolers, distributed along the heat protected zone and independently controllable.

In a $13^{th}$ aspect according to the $12^{th}$ aspect each active cooler is configured to cool at least one cooling structure.

In a $14^{th}$ aspect according to the $12^{th}$ or $13^{th}$ aspect each active cooler comprises a cooling fan configured to blow air towards the cooling structure and/or a liquid cooling system having a cold liquid circuit circulating cold liquid inside or adjacent to the cooling structure and a source of cold associated to the cold liquid circuit.

In a $15^{th}$ aspect according to the $12^{th}$ or $13^{th}$ or $14^{th}$ aspect the apparatus comprises one or more auxiliary temperature sensors operative at the heat protected zone and a/the control unit communicatively connected with the one or more auxiliary temperature sensors and with the active cooler or coolers, wherein the control unit is configured to:

receive auxiliary temperature signals from each of said one or more auxiliary temperature sensors, and control the cooler or coolers based on said one or more auxiliary temperature signals and on one or more respective reference values.

In a $16^{th}$ aspect according to any one of the preceding aspects from 2 to 15, the apparatus comprises a tunnel delimiting or containing the heat treatment zone, the one or more longitudinal openings being defined at a longitudinal side portion of the tunnel.

In a 17th aspect according to the preceding aspect the heat protected zone is positioned adjacent to said one or more longitudinal openings and inside said tunnel.

In an 18th aspect according to the preceding aspect at least a wall, in particular a side wall, of the tunnel facing the heat protected zone is formed in heat insulating material.

In a an optional aspect of the present aspect all walls of the tunnel delimiting the heat treatment zone are made from heat insulating material, in order to heat insulate the heat treatment zone from the heat protected zone.

In a 19th aspect according to any one of the preceding aspects from 2 to 18 the apparatus comprises opposed insulating walls configured for delimiting at least part of the heat protected zone, said opposed insulating walls defining an elongated channel, optionally an elongated flat channel, configured for receiving the terminal portions of each container and having a proximal side ending at said one or more longitudinal openings and a distal side in fluid communication with atmosphere external to the heat treatment zone.

In a 20th aspect according to any one of the preceding aspects in combination with the 3rd aspect first alternative, the longitudinal opening is in the form of a longitudinal slit, in particular of a longitudinal and rectilinear slit, extending from the inlet to the outlet of the heat shrink apparatus.

In a 21st aspect according to any one of the preceding aspects the heat treatment zone extends horizontally.

In a 22nd aspect according to any one of the 21st aspect the heat protected zone extends horizontally and is directly adjacent to the heat treatment zone.

In a 23rd aspect according to any one of the preceding aspects from 3 to 22 the apparatus comprises at least one pair of opposed belts having mutually facing rectilinear belt stretches which are operative at or define the one or more longitudinal openings.

In a 24th aspect according to the preceding aspect each pair of opposed belts comprises:

- two opposed belts, with one of the two belts having a contoured external profile provided with recesses, the two belts having mutually facing rectilinear stretches configured for contacting without sealing the intermediate portion of each processed container; or
- two opposed belts, with both the belts having a contoured external profile provided with recesses, the two belts having mutually facing rectilinear stretches configured for contacting without sealing the intermediate portion of each processed container; or
- two opposed belts with both the belts having a smooth external profile the external profile of the mutually facing rectilinear stretches of the two belts forming a gap for receiving without sealing the intermediate portion of each processed container.

In a 25th aspect according to the 23rd or 24th aspect each pair of opposed belts comprises two driving belts.

In a 26th aspect according to any one of the preceding aspects the apparatus comprises a regulator for adjusting the size, in particular the thickness, of the one or more longitudinal openings and/or

- a further regulator operative on one or both the belts of each pair of opposed belts to adjust the size of the gap formed by, or the entity of pressure between, mutually facing stretches of the two belts forming each pair of belts In a 27th aspect according to any one of the preceding aspects the heat treatment zone comprises a support structure configured for supporting the main portion of each processed container during motion from the inlet to the outlet of the heat shrink apparatus.

In an optional aspect of the present aspect the support structure comprises:

- a plurality of adjacent rollers positioned at intervals along the heat treatment zone, or
- a plurality of adjacent driven rollers positioned at intervals along the heat treatment zone, or
- driven rollers intercalated by idle rollers positioned along the heat treatment zone,
- a sliding plane extending along the heat treatment zone, or
- a conveyor belt extending along the heat treatment zone.

In a 28th aspect according to preceding aspect the support structure has through apertures or passages at intervals for allowing passage of hot air coming from the one or more heaters, wherein the one or more heaters are located below the support structure and configured to direct air towards the processed containers also from below the support structure such that hot air may impinge also on the inferior side of the processed containers.

In a 29th aspect according to any one of the preceding aspects the containers are bags or pouches made from heat shrinkable plastic film, wherein the heat shrinkable plastic film used for making each container shows a free shrinking value at 120° C. (value measured in accordance with ASTM D2732, in oil) in the range from 2% to 80% in both longitudinal and transverse directions, optionally in the range from 5% to 60% in both longitudinal and transverse directions, more optionally in the range from 10% to 40% in both longitudinal and transverse directions.

A 30th aspect concerns a process of heat shrinking a selected portion of containers made from or comprising heat shrinkable plastic film, said containers being of the type having:

- a main portion where a product is housed,
- a terminal portion having at least one aperture allowing gas evacuation from the container, and
- an intermediate portion connecting the main portion and the terminal portion, wherein the process comprises:
- heat shrinking the main portion of each container, and
- during heat shrinking of said main portion, not heat shrinking or heat shrinking the terminal portion of each container significantly less than the main portion.

In a 31st aspect according to the 30th aspect heat shrinking the main portion of each container comprises bringing the main portion of each container at least above a shrink temperature, and

- wherein not heat shrinking or heat shrinking the terminal portion of each container significantly less than the main portion comprises bringing the terminal portion of each container at a temperature below the shrink temperature, optionally at a temperature at least 30° C. below said shrink temperature, more optionally at a temperature at least 50° C. below the shrink temperature.

A 32nd aspect concerns a process of heat shrinking a selected portion of containers made from heat shrinkable plastic film, said containers being of the type having:

- a main portion where a product is housed,
- a terminal portion having at least one aperture allowing gas evacuation from the container, and
- an intermediate portion connecting the main portion and the terminal portion, wherein the process comprises:
- bringing the main portion of each container at least above a shrink temperature for heat shrinking the main portion of each container, and
- at the same time during heat shrinking of said main portion, keeping the terminal portion of each container at a temperature below the shrink temperature, optionally at a temperature at least 30° C. below said shrink temperature, more optionally at a temperature at least 50° below the shrink temperature.

In a 33rd aspect according to any one of the preceding aspects from 30 to 32 heat shrinking the main portion of each container comprises bringing the main portion of each container above 130° C., optionally between 130° C. and 180° C.

In a 34th aspect according to any the 33rd aspect during heat shrinking of the main portion of each container, the respective terminal portion is maintained at a temperature below 100° C., in particular below 90° C.

In a 35th aspect according to any one of the preceding aspects from 30 to 34 the process uses the heat shrink apparatus of any one of the preceding aspects from 1 to 29.

A 36th aspect concerns a process of heat shrinking a selected portion of containers made from heat shrinkable plastic film, said containers being of the type having:

a main portion where a product is housed, a terminal portion having at least one aperture allowing gas evacuation from the container, and an intermediate portion connecting the main portion and the terminal portion, wherein the process uses the shrink apparatus of any one of the preceding aspects from 1 to 29.

In a 37th aspect according to the 35th or 36th aspect said containers are fed to the apparatus inlet, with the main portion of each container being received in the heat treatment zone and with the terminal portion of each container being received in the heat protected zone.

In a 38th aspect according to the 35th or 36th or 37th aspect the containers are displaced from the inlet to the outlet and wherein heating and heat shrinking of the main portion of each container take place while said main portion travels along the heat treatment zone and while the terminal portion of each container travels along the heat protected zone.

In a 39th aspect according to any one of the preceding aspects from 35 to 38 during heat shrinking of the main portion, the intermediate portion of each processed container extends through the one or more openings.

In a 40th aspect according to any one of the preceding aspects from 35 to 39 heat shrinking the main portion of each container comprises maintaining the heat treatment zone a/the shrink temperature, which is above 130° C., optionally comprised between 130° C. and 180° C., while at the same time the heat protected zone is maintained at a temperature below the shrink temperature, optionally at a temperature at least 30° C. below said shrink temperature, more optionally at a temperature at least 50° C. below the shrink temperature.

In a 41st aspect according to any one of the preceding aspects from 30 to 40 the heat treatment zone is heated with hot air.

In a 42nd aspect according to any one of the preceding aspects from 30 to 41 the heat protected zone is cooled with cooling liquid and/or cooling air.

In a 43rd aspect according to any one of the preceding aspects from 30 to 42 wherein the containers, at least during heat shrinking of the main portion, are subjected to a continuous movement, optionally at a constant speed, along a/the heat shrink apparatus.

In a 44th aspect according to any one of the preceding aspects from 30 to 43 during heat shrinking of the main portion of each container, the main portion contracts and contacts the surface of the product forming a plastic skin on and around the same product and causing air to escape from the inside of the main portion via the intermediate portion and out of the container.

In a 45th aspect according to any one of the preceding aspects from 30 to 44 the one or more openings are sized such that, during heating of the main portion of each container, initially air inside the main portion expands the main portion and then heat shrinking causes the main portion to contract and contact the surface of the product forming a plastic skin on and around the same product, causing air to escape from the inside of the main portion via the intermediate portion and out of the container.

In a 46th aspect according to any one of the preceding aspects from 30 to 45 during heat shrinking of the main portion of each container, no vacuum is applied at the terminal end of each container, such that gas is evacuated from the main portion of each container solely by effect of heat shrinking of the same main portion pushing gas out of said aperture.

In a 47th aspect according to any one of the preceding aspects from 30 to 46 the process uses an apparatus according to any one of the preceding aspects from 23 to 27, wherein the intermediate portion of each container is captured between the mutually opposed rectilinear stretches the/each pair of belts.

In a 48th aspect according to the preceding aspect the mutually opposed rectilinear stretches the/each pair of belts contact the surface of the intermediate portion of each container and compress it without however causing an occlusion to gas exiting from the main portion of each container via said intermediate portion.

In a 49th aspect according to any one of the preceding aspects from 30 to 48 the containers are bags or pouches made from heat shrinkable plastic film, wherein the heat shrinkable plastic film used for making each container shows a free shrinking value at 120° C. (value measured in accordance with ASTM D2732, in oil) in the range from 2% to 80% in both longitudinal and transverse directions, optionally in the range from 5% to 60% in both longitudinal and transverse directions, more optionally in the range from 10% to 40% in both longitudinal and transverse directions.

A 50th aspect concerns a heat shrink device for processing containers of the type made from or comprising heat shrinkable plastic film, the containers having a main portion where a product is housed, a terminal portion not occupied by product, and an intermediate portion connecting the main portion and the terminal portion, wherein the device comprises:

a pair of opposed shrink belts, each shrink belt having an operative stretch facing a corresponding operative stretch of the opposite shrink belt, wherein said operative stretches have respective external surfaces defining therebetween a gap configured for receiving the terminal portion of each container to be processed;

a belt heater associated to at least one of said shrink belts and configured for bringing the external surface of at least one operative stretch at least at a shrink temperature, optionally comprised between 130° and 180° C., such that the terminal portion of each processed container passing through said gap is heat shrunk.

In a 51st aspect according to the preceding aspect the heat shrink device comprises a respective belt heater associated to each shrink belt and configured for bringing said external surfaces of both the operative stretches at least at a shrink temperature comprised between 130° C. and 180° C., such that the terminal portion of each processed container passing through said gap is heat shrunk.

In a 52$^{nd}$ aspect according to the 50$^{th}$ or 51$^{st}$ aspect the heat shrink device comprises a flattening body associated to each shrink belt and configured for maintaining flat at least a portion of said external surfaces of the flat stretches.

In a 53$^{rd}$ aspect according to the preceding aspect the flattening body is positioned downstream the belt heater associated to the same belt, with respect to a direction of movement imparted by the opposed shrink belts to the processed containers.

In a 54$^{th}$ aspect according to any one of the preceding aspects from 50 to 53 each one of said operative stretches is a rectilinear stretch having a respective external surface which is a flat surface.

In a 55$^{th}$ aspect according to any one of the preceding aspects from 50 to 54 the gap is a constant thickness planar gap.

In a 56$^{th}$ aspect according to any one of the preceding aspects from 50 to 55 each shrink belt is an endless belt engaged between at least a respective driving pulley and a respective driven pulley.

In a 57$^{th}$ aspect according to any one of the preceding aspects from 50 to 56 the heater associated to each shrink belt is housed inside a loop defined by each respective belt and configured for heating, optionally by direct contact, an inside surface of the respective shrink belt.

In a 58$^{th}$ aspect according to the preceding aspect the heater associated to each shrink belt is configured for heating by direct contact the inside surface of the operative stretch of the respective shrink belt.

In a 59$^{th}$ aspect according to any one of the preceding aspects from 52 to 58 the flattening body associated to each shrink belt is housed inside a loop defined by each respective belt and configured for directly contacting an inside surface of the respective shrink belt.

In a 60$^{th}$ aspect according to any one of the preceding aspects from 50 to 59 the thickness of the gap is comprised between 0.1 mm and 2.0 mm, optionally between 0.3 mm and 1.0 mm.

In a 61$^{st}$ aspect according to any one of the preceding aspects from 50 to 60 the width of each shrink belt is comprised between 20 mm and 60 mm, optionally between 30 mm and 50 mm.

In a 62$^{nd}$ aspect according to any one of the preceding aspects from 50 to 61 the heat shrink device comprises a pair of rollers operative downstream the opposed shrink belts with respect to a direction of movement imparted by the opposed shrink belts to the processed containers, the pair of rollers cooperating to define a nip therebetween for receiving the terminal portion of each container to be processed.

In a 63$^{rd}$ aspect according to any one of the preceding aspects from 50 to 62 the heat shrink device comprises a sealer configured to form a heat sealing band on the terminal portion of each processed bag thereby hermetically sealing each processed container.

In a 64$^{th}$ aspect according to the preceding aspect the sealer is either associated to one or rollers, optionally in the form of a heated circumferential feature on the external surface of one of the rollers, or to one of the opposed belts optionally in the form of a heated feature on the external surface of one or both the opposed shrink belts.

In a 65$^{th}$ aspect according to any one of the preceding aspects from 50 to 64 the containers are bags or pouches made from heat shrinkable plastic film, wherein the heat shrinkable plastic film used for making each container shows a free shrinking value at 120° C. (value measured in accordance with ASTM D2732, in oil) in the range from 2% to 80% in both longitudinal and transverse directions, optionally in the range from 5% to 60% in both longitudinal and transverse directions, more optionally in the range from 10% to 40% in both longitudinal and transverse directions.

A 66$^{th}$ aspect concerns a process of heat shrinking a selected portion of containers made from or comprising heat shrinkable plastic film, said containers being of the type having:

a main portion where a product is housed,
a terminal portion not occupied by product, and
an intermediate portion connecting the main portion and the terminal portion, wherein the process comprises:
heat shrinking the terminal portion of each container, and
during heat shrinking of said terminal portion, not heat shrinking or heat shrinking the main portion of each container significantly less than the terminal portion.

A 67$^{th}$ aspect concerns a process of heat shrinking a selected portion of containers made from heat shrinkable plastic film, said containers being of the type having:

a main portion where a product is housed,
a terminal portion not occupied by product, and
an intermediate portion connecting the main portion and the terminal portion, wherein the process comprises:
bringing the terminal portion of each container at least above a shrink temperature for heat shrinking the terminal portion of each container, and
during heat shrinking of said terminal portion, keeping the main portion of each container at a temperature below the shrink temperature, optionally at a temperature at least 30° C. below said shrink temperature, more optionally at a temperature at least 50° C. below the shrink temperature.

In a 68$^{th}$ aspect according to any one of the preceding aspects from 66 to 67 heat shrinking the terminal portion of each container comprises bringing the terminal portion of each container above 130° C., optionally between 130° C. and 180° C.

In a 69$^{th}$ aspect according to the preceding aspect during heat shrinking of the terminal portion of each container, the respective main portion is maintained at a temperature below 100° C., in particular below 90° C.

In a 70$^{th}$ aspect according to any one of the preceding aspects from 66 to 69 the process uses the heat shrink device of any one of the preceding aspects from 50 to 65.

A 71$^{st}$ aspect concerns a process of heat shrinking a selected portion of containers made from heat shrinkable plastic film, said containers being of the type having:

a main portion where a product is housed,
a terminal portion not occupied by product, and
an intermediate portion connecting the main portion and the terminal portion, wherein the process uses the heat shrink device of any one of the preceding aspects from 50 to 65.

In a 72$^{nd}$ aspect according to the 70$^{th}$ or the 71$^{st}$ aspect the terminal portion of each processed container is inserted into said gap defined by said shrink belts and heat shrunk while travelling within said gap.

In a 73$^{rd}$ aspect according to any one of the preceding aspects from 70 to 73 each respective belt heater associated to each shrink belt is operated for bringing said external surfaces of both the operative stretches at least at a shrink temperature comprised between 130° C. and 180° C., such that the terminal portion of each processed container passing through said gap is heat shrunk.

In a 74$^{th}$ aspect according to any one of the preceding aspects from 70 to 73 the terminal portion of each container, while travelling through said gap, is put in contact with and flattened by said external surfaces of the flat stretches.

In a 75$^{th}$ aspect according to any one of the preceding aspects from 70 to 74 the process comprises squeezing the terminal portion of each processed container between the pair of rollers operative downstream the opposed shrink belts with respect to a direction of movement imparted by the opposed shrink belts to the processed containers.

In a 76$^{th}$ aspect according to any one of the preceding aspects from 70 to 75 the process comprises forming with said shrink belts a heat sealing band on the terminal portion of each processed container thereby hermetically sealing each processed container.

In a 77$^{th}$ aspect according to any one of the preceding aspects from 75 to 76 the process comprises forming with said pair of rollers a heat sealing band on the terminal portion of each processed bag thereby hermetically sealing each processed container.

In a 78$^{th}$ aspect according to any one of the preceding aspects from 66 to 77 the process comprises adjusting the size of said gap before processing said containers.

In a 79$^{th}$ aspect according to any one of the preceding aspects from 66 to 78 the containers are bags or pouches made from heat shrinkable plastic film, wherein the heat shrinkable plastic film used for making each container shows a free shrinking value at 120° C. (value measured in accordance with ASTM D2732, in oil) in the range from 2% to 80% in both longitudinal and transverse directions, optionally in the range from 5% to 60% in both longitudinal and transverse directions, more optionally in the range from 10% to 40% in both longitudinal and transverse directions.

An 80$^{th}$ aspect concerns a packaging line comprising:

a loader of containers made from or comprising heat shrinkable plastic film, the containers having a main portion where a product is housed, a terminal portion having at least one aperture allowing gas evacuation from the container, and an intermediate portion connecting the main portion and the terminal portion; and a heat shrink apparatus according to any one of the aspects from 1 to 29, wherein the loader is configured to supply said containers to the heat shrink apparatus, and wherein the heat shrink apparatus is configured to heat shrink the main portion of each container.

In an 81$^{st}$ aspect according to the preceding aspect the loader is configured to supply said containers to the heat shrink apparatus either in form of interconnected containers or in form of a sequence of separated containers.

In an 82$^{nd}$ aspect according to the 80$^{th}$ or 81$^{st}$ aspect the loader comprises:

a conveyor configured for advancing products to be packaged along an operating path, a film supply configured for supplying a heat shrinkable plastic film along the operating path and for positioning the film around the products forming an almost tubular structure housing the products to be packaged and provided with a longitudinal aperture, a transverse sealer configured for forming seal bands transversal to the almost tubular structure forming a plurality of said containers, each of said containers hosting a respective product.

In an 83$^{rd}$ aspect according to the 80$^{th}$ or 81$^{st}$ aspect the packaging line comprises a heat shrink device according to any one of the preceding aspects from 50 to 65.

In an 84$^{th}$ aspect according to the preceding aspect the heat shrink device is positioned immediately downstream of the heat shrink apparatus and is configured to receive said containers with heat shrunk main portions and to heat shrink the terminal portions of each processed container.

In an 85$^{th}$ aspect according to the preceding aspect the heat shrink device is also configured to form a heat seal band across the terminal portion of each processed container to hermetically close said aperture and form closed packages.

In an 86$^{th}$ aspect according to any one of the preceding aspects from 80 to 83 the packaging line comprises a vacuum station configured for receiving the terminal portions of the processed containers and to suck gas from each container via said aperture.

In an 87$^{th}$ aspect according to the preceding aspect the vacuum station is positioned immediately downstream of the heat shrink apparatus and it is configured to receive said containers with heat shrunk main portions coming from the heat shrink apparatus.

In an 88$^{th}$ aspect according to any one of the preceding aspects from 86 to 87 the vacuum station is configured for applying to the terminal portions of the processed containers a pressure lower than the pressure present inside the main portions, thereby sucking gas from each container via said aperture.

In an 89$^{th}$ aspect according to any one of the preceding aspects from 86 to 88 the vacuum station is operatively positioned between the heat shrink apparatus and the heat shrink device and is configured to deliver to the heat shrink device vacuumized containers having heat shrunk main portions.

In a 90$^{th}$ aspect according to any one of the preceding aspects from 86 to 89 the vacuum station comprises a heat sealer configured to form a heat seal band across the terminal portion of each processed container to hermetically close said aperture and form closed packages.

In a 91$^{st}$ aspect according to any one of the preceding aspects from 86 to 90 the vacuum station comprises:

an elongated vacuum chamber having an elongated opening extending along the vacuum chamber, a vacuum source configured for providing the vacuum chamber with an internal vacuum pressure that is lower than an ambient pressure outside the vacuum chamber, a conveyor supporting the main portion of the processed containers and configured for moving the processed containers relative to the vacuum chamber, the containers to be evacuated being positioned so that, during the relative movement of the each container with respect to the vacuum chamber, the terminal portion of each container relatively moves within the vacuum chamber and the main portion of each container relatively moves outside the vacuum chamber, the intermediate portion passing through and relatively moving along the elongated opening.

In a 92$^{nd}$ aspect according to the preceding aspect the vacuum station comprises:

a first guide belt arranged along a length of the elongated opening and configured with an outer surface contacting the terminal portion of each processed container, wherein the outer surface of the first guide belt is optionally provided with a contoured shape comprising recesses, and a second guide belt arranged along said length of the elongated opening, opposed to the first guide belt and configured with a respective outer surface contacting the terminal portion of each processed container, wherein the outer surface of the first guide belt is optionally provided with a contoured shape comprising recesses.

In a 93$^{rd}$ aspect according to the 91$^{st}$ or 92$^{nd}$ aspect the vacuum chamber comprises a first sub-chamber and a second sub-chamber and wherein the vacuum station is configured to provide the first sub-chamber with a first pressure and to provide the second sub-chamber with a second pressure different from, optionally lower than, the first pressure, and with the first pressure having an absolute pressure value lower than the ambient pressure.

In a 94$^{th}$ aspect according to any one of the preceding aspects from 80 to 93 the packaging line comprises a cutting station configured for transversely severing the interconnected containers and form a plurality of separated containers, wherein the cutting station is operative downstream the heat shrink apparatus, in particular downstream the heat shrink device.

In a 95$^{th}$ aspect according to any one of the preceding aspects from 80 to 94 the packaging line comprises a forming station configured for forming an easy opening feature, optionally a cut or notch or a weakening line, at one of the peripheral borders of each processed container, wherein the forming station is operative downstream the heat shrink apparatus, in particular downstream the heat shrink device.

In a 96$^{th}$ aspect according to any one of the preceding aspects from 80 to 95 the packaging line comprises a redirecting station configured to orient each processed container such that its terminal portion is oriented towards a direction of motion of the container downstream the redirecting station, wherein the redirecting is operative downstream the heat shrink apparatus, in particular downstream the heat shrink device.

In a 97$^{th}$ aspect according to any one of the preceding aspects from 80 to 96 the packaging line comprises a heat shrink finisher operative downstream the heat shrink apparatus, in particular downstream the heat shrink device, and configured to direct hot air, optionally hot air at a temperature comprised between 130° C. and 180° C., at least towards the intermediate portion of each processed container.

In a 98$^{th}$ aspect according to the preceding aspect the heat shrink finisher comprises two opposite hot air blowers configured for acting on opposite sides of the intermediate portion of each processed container, wherein said two air blowers are independently controlled for bending the terminal portion of each processed container.

In a 99$^{th}$ aspect according to any one of the preceding aspects from 80 to 98 the packaging line comprises a labelling station configured for applying at least one label to each processed container, optionally to the terminal portion of each processed container, the labelling station being operative downstream the heat shrink apparatus, in particular downstream the heat shrink device and the redirecting station.

A 100$^{th}$ aspect concerns a packaging process comprising:

providing a plurality of containers made of or comprising heat shrinkable plastic film, the containers having a main portion where a product is housed, a terminal portion having at least one aperture allowing gas evacuation from the container, and an intermediate portion connecting the main portion and the terminal portion, executing on said containers a process of heat shrinking a selected portion of the containers according to any one of the preceding aspects from 30 to 49 forming partially shrunk containers having said main portion housing the product which has been heat shrunk.

In a 101$^{st}$ aspect according to the preceding aspect the process comprises providing said plurality of containers is achieved by forming a plurality of plastic containers from heat shrinkable plastic film, wherein said forming comprises:

advancing a heat shrinkable plastic film along an operating path, advancing products to be packaged along the operating path together with the plastic film, positioning the plastic film around the products before formation of the containers, the plastic film being a continuous plastic film shaped into an almost tubular film structure receiving the products;

forming on the almost tubular film structure transversal heat seal bands, oriented transversally to a direction of advancement of the plastic film along the operating path, to form said plurality of containers, which are consecutively arranged.

In a 102$^{nd}$ aspect according to the preceding aspect the almost tubular structure has a longitudinal aperture, optionally a longitudinal side aperture, and wherein the containers formed from the almost tubular structure are either in the form of interconnected containers or, if a severing sub step takes place, in the form of a sequence of separated containers.

In a 103$^{rd}$ aspect according to any one of the preceding aspects from 100 to 102 the process comprises executing on said partially shrunk containers a process of heat shrinking a selected portion of the containers according to any one of the preceding aspects from 66 to 79 obtaining containers with both the main portion and the terminal portion which have been heat shrunk.

In a 104$^{th}$ aspect according to any one of the preceding aspects from 100 to 103 the process comprises forming a heat seal band across the terminal portion of each processed container to hermetically close said aperture and form closed packages.

In a 105$^{th}$ aspect according to any one of the preceding aspects from 100 to 104 the process comprises receiving said containers at a vacuum station and withdrawing gas from each container via said aperture by applying a vacuum from outside each terminal portion.

In a 106$^{th}$ aspect according to the preceding aspect the steps of receiving said containers at a vacuum station and withdrawing gas take place after said main portion of the containers housing the product has been heat shrunk.

In a 107$^{th}$ aspect according to the 105$^{th}$ or 106$^{th}$ aspect the steps of receiving said containers at a vacuum station and withdrawing gas take place before heat shrinking the terminal portion of containers.

In a 108$^{th}$ aspect according to any one of the preceding aspects from 105 to 107 the vacuum station applies to the terminal portions of the processed containers a pressure inferior to the pressure present inside the main portions, thereby sucking gas from each container via said aperture.

In a 109$^{th}$ aspect according to any one of the preceding aspects from 105 to 108 the vacuum station forms vacuumized containers having heat shrunk main portions.

In a 110$^{th}$ aspect according to any one of the preceding aspects from 105 to 109 the vacuum station comprises a heat sealer forming a heat seal band across the terminal portion of each processed container to hermetically close said aperture and form closed packages.

In a 111$^{th}$ aspect according to any one of the preceding aspects from 105 to 110 the vacuum station comprises a heat sealer forming a heat seal band perpendicular to the terminal portion of each processed container to hermetically close said aperture and form closed packages.

In a 112$^{th}$ aspect according to any one of the preceding aspects from 105 to 110 the vacuum station comprises:

an elongated vacuum chamber having an elongated opening extending along the vacuum chamber, a vacuum source providing the vacuum chamber with an internal vacuum pressure that is lower than an ambient pressure outside the vacuum chamber, a conveyor supporting the main portion of the processed containers and moving the processed containers relative to the vacuum chamber, the containers to be evacuated being positioned so that, during the relative movement of the each container with respect to the vacuum chamber, the terminal portion of each container relatively moves within the vacuum chamber and the main portion of each container relatively moves outside the vacuum chamber, the intermediate portion passing through and relatively moving along the elongated opening.

In a 113$^{th}$ aspect according to any one of the preceding aspects from 100 to 112 the containers are interconnected and wherein a cutting station transversely severs the interconnected containers and forms a plurality of separated containers, wherein severing takes place after said main portion of the containers housing the product has been heat shrunk, optionally after also said terminal portion of the containers has been heat shrunk.

In a 114$^{th}$ aspect according to any one of the preceding aspects from 100 to 113 the process comprises forming an easy opening feature, optionally a cut or notch or a weakening line, at one of the peripheral borders of each processed container, wherein forming the easy opening feature takes place after said main portion of the containers housing the product has been heat shrunk, optionally after also said terminal portion of the containers has been heat shrunk.

In a 115$^{th}$ aspect according to any one of the preceding aspects from 100 to 114 the process comprises redirecting each processed container such that its terminal portion extends forward from the main portion towards a direction of motion of the container, wherein redirecting takes place after said main portion of the containers housing the product has been heat shrunk, optionally after also said terminal portion of the containers has been heat shrunk.

In a 116$^{th}$ aspect according to any one of the preceding aspects from 100 to 115 the process comprises a heat shrink finishing step, which takes place after said main portion of the containers housing the product has been heat shrunk and after also said terminal portion of the containers has been heat shrunk, heat shrink finishing step comprising directing hot air, optionally hot air at a temperature comprised between 130° C. and 180° C., at least towards the intermediate portion of each processed container.

In a 117$^{th}$ aspect according to the preceding aspect the heat shrink finishing step uses two opposite hot air blowers acting on opposite sides of the terminal portion of each processed container, wherein said two air blowers are independently controlled and by piloting the respective hot air jets in a differentiated manner cause a controlled bending of the terminal portion of each processed container.

In a 118$^{th}$ aspect according to any one of the preceding aspects from 100 to 117 the process comprises applying at least one label to each processed container, optionally to the terminal portion of each processed container, wherein the labelling takes place after said main portion of the containers housing the product has been heat shrunk, optionally after also said terminal portion of the containers has been heat shrunk.

In a 119$^{th}$ aspect according to any one of the preceding aspects from 100 to 118 the containers are bags or pouches made from heat shrinkable plastic film, wherein the heat shrinkable plastic film used for making each container shows a free shrinking value at 120° C. (value measured in accordance with ASTM D2732, in oil) in the range from 2% to 80% in both longitudinal and transverse directions, optionally in the range from 5% to 60% in both longitudinal and transverse directions, more optionally in the range from 10% to 40% in both longitudinal and transverse directions.

In a 120$^{th}$ aspect according to any one of the preceding aspects from 100 to 119 the process uses the packaging line of any one of the preceding aspects from 80 to 99.

A 121$^{st}$ aspect concerns a gas tightly closed package obtained with the process of any one of the preceding aspects from 30 to 49.

A 122$^{nd}$ aspect concerns a gas tightly closed package obtained with the process of any one of the preceding aspects from 66 to 79.

A 123$^{rd}$ aspect concerns a gas tightly closed package obtained with the process of any one of the preceding aspects from 100 to 120.

BRIEF DESCRIPTION OF THE DRAWINGS

Some embodiments and some aspects of the invention are described hereinafter with reference to the accompanying drawings, provided only for illustrative and, therefore, non-limiting purposes, in which:

FIG. 5 shows an enlarged view the circled portion of the apparatus of FIG. 3;

FIG. 6 shows an enlarged view the circled portion of the apparatus of FIG. 4;

CONVENTIONS

Figure 1:
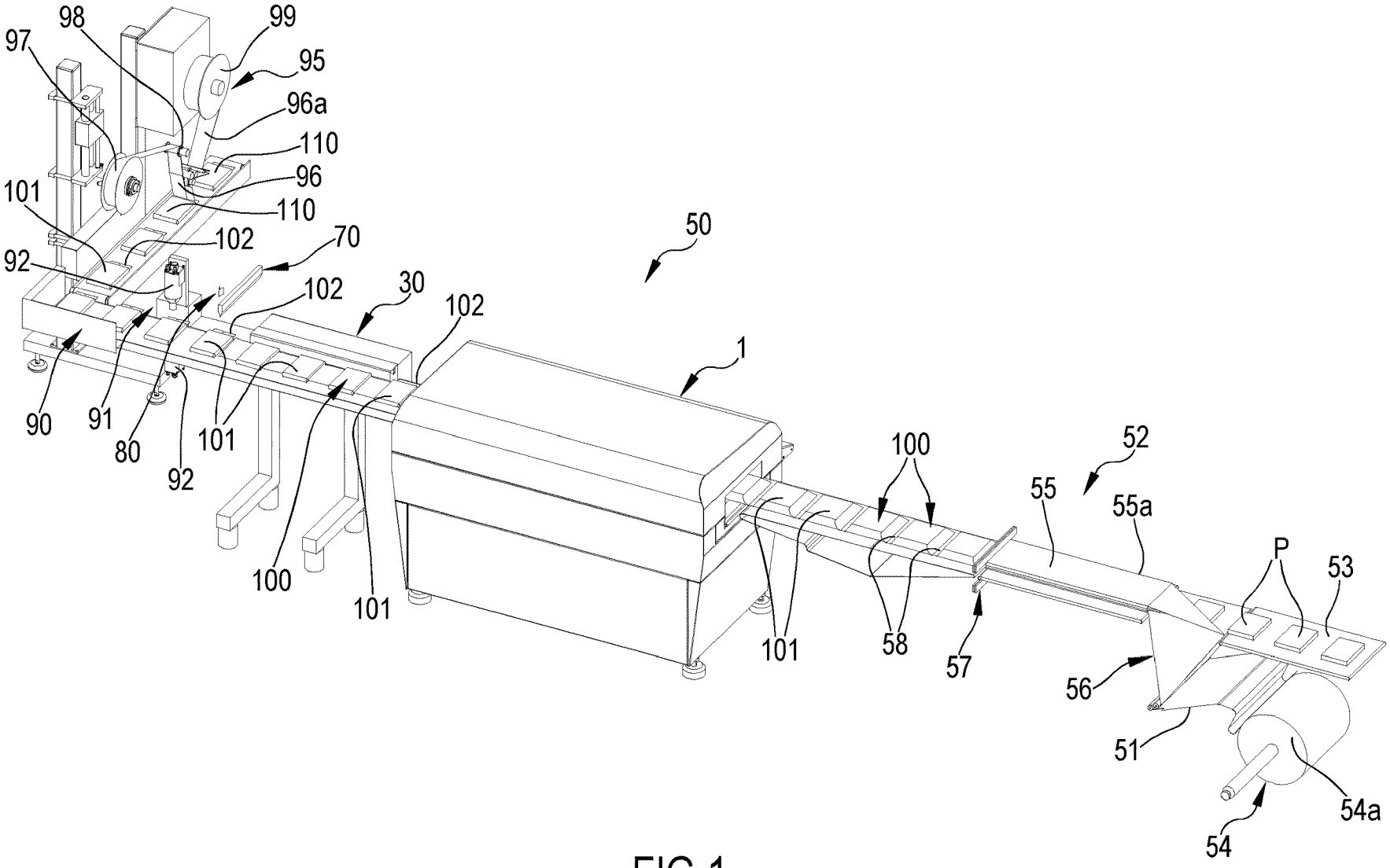
FIG. 1 is a schematic perspective view of a first packaging line according to aspects of the invention.

It should be noted that in the present detailed description, corresponding parts illustrated in the various figures are indicated by the same reference numerals. The figures may illustrate the object of the invention by representations that are not in scale; therefore, parts and components illustrated in the figures relating to the object of the invention may relate solely to schematic representations.

The terms upstream and downstream refer to a direction of advancement of the containers or packages being processed along a predetermined operating path.

Definitions

Product

The term product P means an article or a composite of articles of any kind. For example, the product may be of a foodstuff type and be in solid, liquid or gel form, i.e. in the form of two or more of the aforementioned aggregation states. In the food sector, the product may comprise: meat, fish, cheese, treated meats, prepared and frozen meals of various kinds.

Control Unit

The heat shrink apparatus, the heat shrink device and the packaging line described herein include at least one control unit 200 designed to control part or all the steps of the processes herein described and claimed for making the package. The control unit may be only one or be formed by a plurality of different control units, for example at least one associated to apparatus 1, at least one associated to device 30 and at least one governing controller for the line 50. Of course, different configurations may be envisaged according to the design choices and the operational needs. The term control unit means an electronic component which may comprise at least one of: a digital processor (for example comprising at least one selected from the group of: CPU, GPU, GPGPU), a memory (or memories), an analog circuit, or a combination of one or more digital processing units with one or more analog circuits. The control unit can be "configured" or "programmed" to perform some steps: this can be done in practice by any means that allows configuring or programming the control unit. For example, in the case of a control unit comprising one or more CPUs and one or more memories, one or more programs can be stored in appropriate memory banks connected to the CPU or to the CPUs; the program or programs contain instructions which, when executed by the CPU or the CPUs, program or configure the control unit to perform the operations described in relation to the control unit. Alternatively, if the control unit is or includes analog circuitry, then the control unit circuit may be designed to include circuitry configured, in use, for processing electrical signals so as to perform the steps related to control unit. The control unit may comprise one or more digital units, for example of the microprocessor type, or one or more analog units, or a suitable combination of digital and analog units; the control unit can be configured for coordinating all the actions necessary for executing an instruction and instruction sets.

The Film

The film used for forming the containers (e.g., bags or pouches) and packages of the invention is made of plastic material, in particular polymeric material; the film is for example a flexible mono or multilayer material comprising at least an outer heat-weldable layer. In case of a multilayer film, the film may include an optional gas barrier layer and a one or more protective layers.

The film, in a currently preferred option, is a heat-shrinkable plastic film showing a free shrinking value at 120° C. (value measured in accordance with ASTM D2732, in oil) in the range from 2% to 80%, optionally from 5% to 60%, in particular from 10% to 40%, in both longitudinal and transverse directions. As used herein the terminology "heat-shrinkable," "heat-shrink," and the like, refer to the tendency of film to shrink upon the application of heat, such that the size of the film decreases while the film is in an unrestrained state.

The plastic film material has preferably thickness comprised between 10 and 60 μm, optionally between 15 and 45 μm. In one example, the plastic film material has thickness comprised between 20 and 35 μm and is heat-shrinkable showing the free shrinking value indicated above.

Although, any plastic film with the above thickness, optionally made in shrinkable material with the above shrink properties would be adequate to implement the claimed invention, suitable exemplifying materials are disclosed in the following publications, which are herein incorporated by reference: EP2477813, EP2805821, EP1140493, EP987103, EP881966, EP801096.

DETAILED DESCRIPTION

Heat Shrink Apparatus 1 for Heat Treating Main Portions 101 of Containers 100

Figure 3:
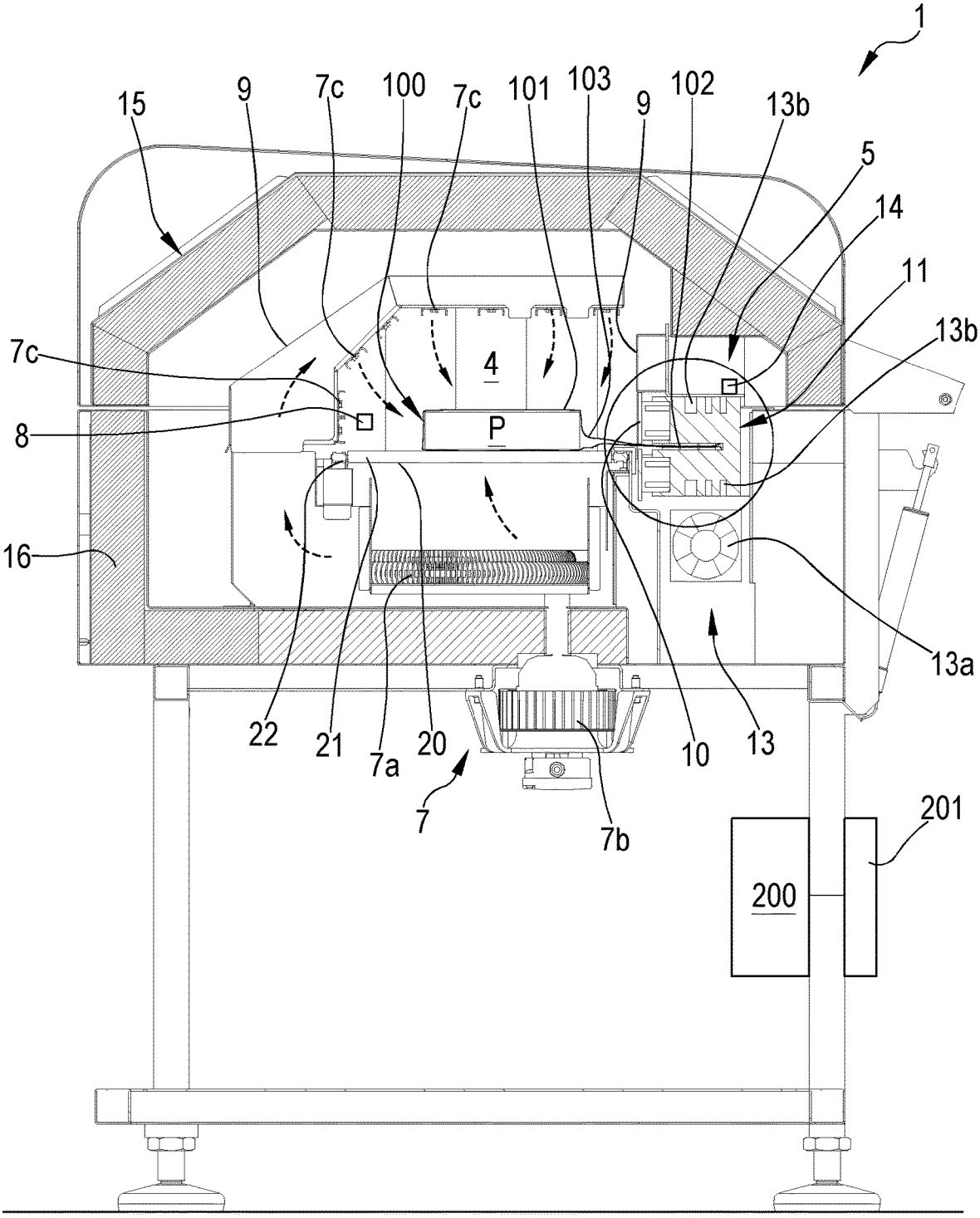
FIG. 3 is a cross section of a heat shrink apparatus which is part of the packaging line of FIG. 1 and in the packaging line of FIG. 2.
Figure 4:
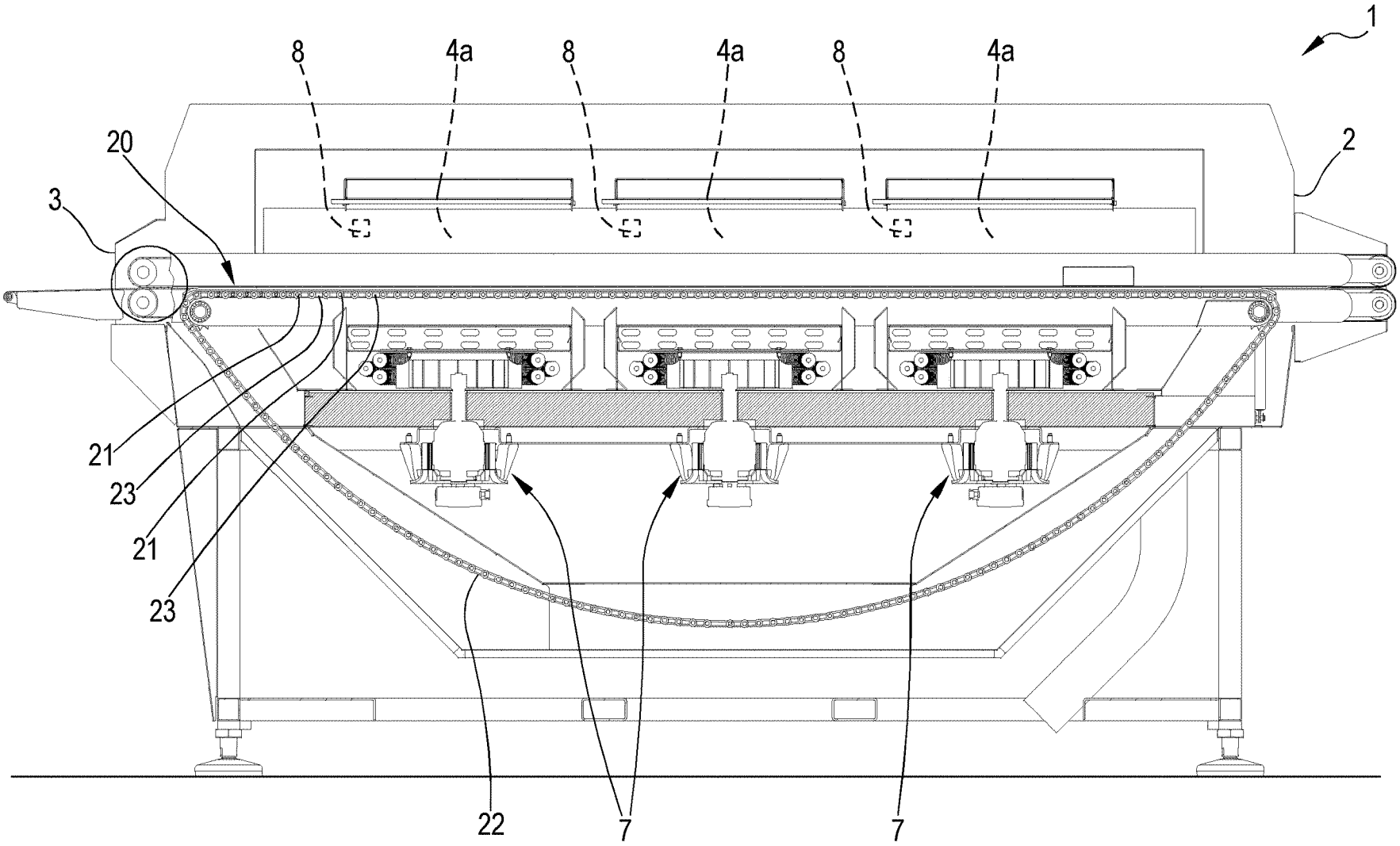
FIG. 4 is a longitudinal section of the heat shrink apparatus of FIG. 3.

In FIGS. 3 and 4 a heat shrink apparatus according to aspects of the invention is indicated with reference number 1. The heat shrink apparatus 1 is adapted to process containers 100 having a main portion 101 where a product P is housed, a terminal portion 102 having at least one aperture 102*a* (in particular a terminal open mouth—see FIG. 5) allowing gas evacuation from the container, and an intermediate portion 103 connecting the main portion and the terminal portion. The containers disclosed herein are of the type made from or comprising heat shrinkable plastic film: in particular the containers 100 may be bags or pouches entirely made for heat shrinkable plastic film material. For example the containers are bags or pouches made from heat shrinkable plastic film, wherein the heat shrinkable plastic film used for making each container shows a free shrinking value at 120° C. (value measured in accordance with ASTM D2732, in oil) in the range from 2% to 80% in both longitudinal and transverse directions. In accordance with a currently preferred variant the heat shrinkable plastic film used for making each container shows a free shrinking value at 120° C. (value measured in accordance with ASTM D2732, in oil) in the range from 5% to 60% in both longitudinal and transverse directions or in the range from 10% to 40% in both longitudinal and transverse directions.

The shrink apparatus 1 comprises an inlet 2 for receiving containers to be processed and an outlet 3 for delivering processed containers. A heat treatment zone 4 (see FIG. 3) is defined between the inlet and the outlet: the heat treatment zone 4 is configured to heat shrink the main portion 101 of processed containers. In practice, the heat treatment zone 4 only receives the main portion 101 of the processed containers 100 and is configured to direct heat basically only onto the containers main portion. At this purpose, the heat shrink apparatus 1 comprises a heat protected zone 5 extending adjacent to the heat treatment zone 4 and configured for receiving the terminal portion 102 of each container and for protecting the terminal portion from heat coming from the heat treatment zone 4, such that the terminal portion 102 of each container 100 is not heat shrunk or at most minimally heat shrunk to an extent largely inferior to the heat shrinking applied to the main portion 101. In other words, the heat shrink apparatus 1 is a capable of selectively heat shrinking only or substantially only the main portion 101 of each processed container.

The heat protected zone 5 is connected to the heat treatment zone 4 via one or more openings 6 (see FIG. 5) extending between the heat treatment zone 4 and the heat protected zone 5: in this way, each of the processed containers 100 may have the respective main portion 101 travelling in the heat treatment zone 4, the respective intermediate portion 103 crossing the mentioned one or more openings 6, while the terminal portion 102 remains protected by and travels inside the heat protected zone 5.

Note that depending upon the variants, the one or more openings 6 may comprise a single longitudinal opening extending along to the entire heat treatment zone and positioned between the heat treatment zone 4 and the heat protected zone 5: the single longitudinal opening may for example be in the form of a longitudinal slit or of a thin and elongated opening configured for receiving at least the intermediate portion of each processed container, such that, during operation of the heat shrink apparatus, the main portion 101 of each processed container 100 is received in the heat treatment zone 4, while the terminal portion 102 of each processed container remains outside the heat treatment zone 4 with the intermediate portion of each container passing through the longitudinal opening 6.

In an alternative variant, the apparatus may present a plurality of discrete openings 6 formed along the heat treatment zone and each configured for receiving the intermediate portion 103 of a respective processed container 100, such that, during operation of the heat shrink apparatus, the main portion 101 of each processed container is received in the heat treatment zone 4, while the terminal portion 102 of each processed container remains outside the heat treatment zone with the intermediate portion of each container passing through a respective discrete opening 6.

In order to properly support the processed containers 100 during heat treatment, the heat treatment zone 4 also comprises a support structure 20 configured for supporting the main portion 101 of each processed container during motion from the inlet 2 to the outlet 3 of the heat shrink apparatus 1. The support structure 20 may for example be formed by a plurality of adjacent rollers 21 (for example idle rollers with axis of rotation orthogonal to the direction of movement of the containers in the zone 4) positioned at intervals along the heat treatment zone and displaceable along a closed path, which comprises a top segment extending from said inlet 2 to said outlet 3, by a chain mechanism 22 operative at each end of the rollers 21, as shown in FIG. 4. Alternatively, the support structure 20 may comprise idle rollers and driven rollers positioned at intervals along the heat treatment zone or all driven rollers. Of course other alternative designs (not shown) of the support structure 20 may be contemplated such as a simple sliding plane extending along the heat treatment zone, or a conveyor belt extending along the heat treatment zone and actively driving the main portions of the processed containers. In case driven means are used such as one or more driven rollers or one or more conveyor belts, these driven means are controlled by the control unit 200 and synchronized with the motion of the pair of belts acting on the intermediate portion of the processed packages (as it will be further explained below).

In accordance with an aspect, the apparatus 1 is configured to keep the heat treatment zone 4 at a shrink temperature sufficiently high to heat shrink the material of the film used to form the containers 100, while at the same time keeping the heat protected zone 5 at a temperature sufficiently below the film shrink temperature: for example in a currently preferred option the apparatus 1 is configured for keeping the heat protected zone at a temperature at least 30° C. below said shrink temperature, optionally at a temperature at least 50° below the shrink temperature.

In greater detail, the heat treatment zone 4 comprises at least one heater 7 which, during operation of the apparatus, is configured to maintain the heat treatment zone at a/the shrink temperature, which is above 130° C., optionally comprised between 130° and 180° C., more optionally in a range of 160°+10° C. The temperature range maintained in the heat treatment zone 4 depends upon the material of the film used for the containers 100 and may be set by a user acting on a user interface 201 associated to a control unit 200 operatively connected to and controlling the one or more heaters 7. In the example shown, the apparatus and specifically the heat treatment zone comprises a plurality of independently controllable heaters 7 (for example controllable by said control unit 200): in a possible implementation 2 to 5 or even more independently controllable heaters 7 may be used, distributed along longitudinal development of the heat treatment zone 4, as shown in FIG. 4, thereby defining a corresponding plurality of independently heat controllable consecutive longitudinal sections 4*a* of the heat treatment zone 4. In the example shown, the heat treatment zone also has one or more temperature sensors 8, distributed along the heat treatment zone: the control unit 200 is communicatively connected with the one or more temperature sensors 8 and with the heater or heaters 7. In detail, the control unit 200 is configured to:

- receive temperature signals from each of said one or more temperature sensors 8 and
- control the heater or heaters 7 based on said one or more temperature signals and on one or more reference values.

In particular, the control unit 200 is configured to control the heater or heaters 7 based on said one or more temperature signals and on one or more reference values in order to maintain the temperature of the heat treatment zone within a set temperature above 130° C., optionally comprised between 130° and 180° C., more optionally in a range of 160°+10° C.

From a structural point of view, each one of the heaters 7 comprises a heating source 7*a* (for example an electric resistor or a IR heating source or other) and one or more fans 7*b* configured to blow on the heating source and direct hot hair in the heat treatment zone, for example via appropriate channels leading to nozzles 7*c* which are distributed on a top portion and on one or more sides of the heat treatment zone 4, as shown in FIG. 4, to thereby direct hot air towards the processed containers both from above and from one or more sides. In accordance with one additional aspect the support structure 20 described above has through apertures or passages 23 at intervals (in case the support surface is formed by rollers this is evident, but also in case the support surface is defined by a conveyor or by a sliding plane a plurality of through apertures may be distributed all along the support surface) for hot air coming from the heater 7, which is conveniently located below the support structure 20, and configured to direct air towards the processed containers also from below the support structure such that hot air may impinge also on the inferior side of the processed containers. In this way, the heat treatment zone is uniformly a heated and the containers main portions 101 uniformly treated with hot air, thus performing an efficient heat shrinking with the heated air without use of any liquid.

As to the heat protected zone 5, the apparatus 1 is configured during operation (i.e., while the containers 100 are processed and the main portions thereof heat treated and shrunk in the heat treatment zone 4) to keep the heat protected zone 5 at a temperature below 100° C., in particular below 90° C.

In order to protect the heat protected zone 5 from heat generated in the heat treatment zone, one or more heat insulators 9 delimit the heat treatment zone 4 and are in particular in the form of one or more heat insulating walls positioned at the periphery of the heat treatment zone. The heat insulators 9 include at least one heat insulating wall or diaphragm 10 just interposed between the heat protected zone 5 and the heat treatment zone and delimiting the opening(s) 6. As shown in FIG. 5, there may be two adjacent heat insulating walls or diaphragms 10 located at the opening(s) 6 on opposite sides of the same opening(s). The heat protected zone 5 of the enclosed example also comprises a cooling structure 11 defining an elongated seat 12 (FIG. 5), which may for example be in the form of an elongated flat channel, configured for receiving the terminal portions 102 of each processed container: the seat 12 has a proximal side 12*a* ending at said one or more longitudinal openings 6 in order to receive the containers terminal portions. In the example shown, the mentioned heat insulating wall 10 is interposed between the side of the cooling structure 11 proximal to the heat treatment zone 4 and the same heat treatment zone 4, such that on the one side the wall 10 provides an insulating effect and on the other the cooling structure further acts in cooling the received terminal portions 102. The cooling structure 11 may be formed by one or more longitudinally extending bodies made in heat conductive material (such as metal, in particular Aluminum) and may be provided with heat dissipating features such as protruding cooling fins. As shown in FIGS. 3 and 6, the heat protected zone comprises at least one active cooler 13 which, during operation of the apparatus 1, is configured to act on the cooling structure 11 to keep the elongated seat 12 of the heat protected zone at a temperature at least 30° C. below said shrink temperature, more optionally at a temperature at least 50° below the shrink temperature. For example the heat protecting structure 5 may have a plurality of coolers, for example from 2 to 5 coolers, distributed along the heat protected zone and independently controllable by the control unit 200.

Each cooler 13 may be configured to cool at least cooling structure described above and may at this purpose comprises a cooling fan 13*a* configured to blow cold air towards cooling structure 11 and/or a liquid cooling system having a source of cold liquid (not shown) and an associated cold liquid circuit 13*b* circulating cold liquid inside or adjacent to cooling structure 11 via appropriate pipes or channels.

In accordance with a further aspect, the heat protected zone may further include one or more auxiliary temperature sensors 14 operative at the heat protected zone: in this case the control unit 200 would be communicatively connected with the one or more auxiliary temperature sensors 14 and with the active cooler or coolers 13 and would be configured to:

- receive auxiliary temperature signals from each of said one or more auxiliary temperature sensors 14, and
- control the cooler or coolers 13 based on said one or more auxiliary temperature signals and on one or more respective reference values, for example to maintain the temperature in the longitudinal seat of the cooling structure below the shrink temperature by at least 30° C., optionally 50° C. and thus avoid heat shrinking of the terminal portions 102 of the processed packages.

In the example of the attached figures the shrink apparatus 1 comprises a tunnel 15 delimiting or containing the heat treatment zone (the tunnel 15 being preferably formed from wall(s) 16 in insulating material) and optionally the heat protected zone 4: as it is visible the longitudinal opening(s) is for example defined at a longitudinal side portion of the tunnel facing the heat protected zone 5. On its turn, the heat protected zone is positioned adjacent the one or more longitudinal openings and may extend on a side of said tunnel. In a currently preferred variant all walls of the tunnel are made from heat insulating material. The above described longitudinal opening 6 is for example in the form of a longitudinal slit, in particular of a longitudinal and rectilinear slit, through the wall 10 which extends in the tunnel and extends from the inlet to the outlet of the heat shrink apparatus and which separates the heat treatment zone from the heat protected zone.

Note that although in the example herein described, the heat treatment zone and the heat protected zone extend horizontally, nothing excludes the heat shrink apparatus 1 and thus the heat treatment zone 4 and the heat protected zone 5 be inclined or vertical, with the containers thus moving from inlet to outlet along a non-horizontal path.

In accordance with a further aspect, a pair of opposed belts 17 having mutually facing rectilinear belt stretches 17*a* operate in correspondence of said opening(s) 6. In practice, the opening or openings 6 may be formed on the wall 10 interposed between the heat treatment zone and the heat protected zone and the two belts 17 may be placed immediately adjacent to said opening(s) 6 and said wall 10, or alternatively the openings may directly be defined by the mutually facing belt stretches of the two cooperating and opposed belts 17. As it is visible from FIG. 6, the two opposed belts are endless belts engaged to respective two or more pulleys 18 at least one of which is a driven pulley.

Each pair of opposed belts is designed according one the following alternatives:

- the pair of opposed belts 17 comprises two belts with one of the two belts having a contoured external profile provided with recesses 19; in this case the two belts have the mutually facing rectilinear stretches configured for contacting without sealing the intermediate portion of each processed container: in fact, the external surface of both belts touches in operation the opposed external surfaces of the intermediate portion of each container being processed thereby facilitating transport and precise control of the container during treatment; on the other hand the recesses on one of the belt external surfaces define air escape channels 19*a* through which air/gas contained inside the main portion of each container may be exhausted; or
- the pair of opposed belts 17 comprises two opposed belts, with both the belts (example shown in FIG. 6) having a contoured external profile provided with recesses 19; in this case the two belts have the mutually facing rectilinear stretches 17*a* configured for contacting without sealing the intermediate portion of each processed container: in fact, the external surface of both belts touches in operation the opposed external surfaces of the intermediate portion of each container being processed thereby facilitating transport and precise control of the container during treatment; on the other hand the recesses 19 on each one of the two belts external surfaces define air escape channels 19*a* through which air/gas contained inside the main portion of each container may be exhausted; or
- the pair of opposed belts comprises two opposed belts with both the belts having a smooth external profile; in this case the external profile of the mutually facing rectilinear stretches of the two belts, in operation, forms a gap for receiving without sealing the intermediate portion of each processed container; note that the belt surfaces at the rectilinear stretches may come into contact with the opposite side surfaces of the terminal portion of each processed package however without creating on the terminal portion a pressure sufficient to sealingly occlude the terminal portions and rather leaving ability to air/gas contained in the main portion of each package to escape to the containers' apertures via the inside of the terminal portions.

In all the above variants, the apparatus 1 may include a regulator for adjusting the size, in particular the thickness, of the one or more longitudinal openings 6. In a possible option, there may also be a further regulator operative on one or both the belts of each pair of opposed belts to adjust the size of the gap or the entity of pressure between mutually facing stretches of the two belts forming each pair of belts.

In this way it is possible to adapt the size of the opening(s) and/or of the gap between the belts to the specific containers treated and thus to the actual thickness of the film used, thereby adjusting the resistance offered by the terminal portions of each contained to air/gas passage. This may be advantageous to obtain during heat treatment in the heat treatment zone an initial bubbling of the main portion which may initially expand due to expansion of the gas contained therein (as gas inside the heat treatment zone but outside the containers may easily escape to the outside environment at least given the presence of the inlet and outlet apertures of the apparatus) and due to the resistance offered to air passage by the terminal portions of each container and then when the shrink effect and related forces increase the main portion significantly contracts expelling a major portion of gas contained in the containers main portions.

Process of Heat Shrinking the Main Portion 101 of the Containers 100 Using Apparatus 1

Another aspect of the invention concerns a process of heat shrinking a selected portion of the described containers 100: in particular, the process uses the apparatus 1 and allows to heat shrink the main portion 101 of each processed container 100 without basically heat shrinking the terminal portion 102 of the same containers or heat shrinking the terminal portion of each container significantly less than the main portion. During the process the containers 100 are fed to the apparatus inlet 2, with the main portion 101 of each container received in the heat treatment zone 4 and with the terminal portion 102 of each container received in the heat protected zone 5. Motion of the containers is continuous at a given speed (greater than zero and preferably constant). Of course a discontinuous step by step movement is not excluded. Motion to the containers may be imparted by the support structure or by driving means operative downstream the apparatus 1.

Thus, the containers are displaced from the inlet 2 to the outlet 3: heating and heat shrinking of the main portion 101 of each container take place while the main portion travels along the heat treatment zone 4 and while the terminal portion 102 of each container travels along the heat protected zone 5.

Heat shrinking the main portion 101 of each container takes place when the main portion of each container is inside the heat treatment zone 4 of the apparatus 1 and is at least brought above a shrink temperature causing shrink of the film material forming said main portion. At the same time the terminal portion 102 of each container is maintained outside the heat treatment zone and sufficiently insulated from this latter, such that no heat shrinking (or just a minimal heat shrinking significantly less than that on the main portion) occurs to the terminal portion which is constantly maintained at a temperature below the shrink temperature, optionally at a temperature at least 30° C. below said shrink temperature, more optionally at a temperature at least 50° below the shrink temperature.

Going in further details, the apparatus 1 is controlled such that the heat treatment zone 4 is heated to bring the main portion of each container above 130° C., optionally between 130° and 180° C., while at the same time the heat protected zone maintains the respective terminal portion of each container at a temperature below 100° C., in particular below 90° C. As described above, the heater or heaters 7 of apparatus 1 are activated and the heat treatment zone 4 is heated with hot air, which is then delivered onto the main portion 101 determining heat shrinking without use of liquid.

During heat shrinking of the main portion 101, the intermediate portion 103 of each processed container extends through the one or more openings 6 (and if present between the opposite belts 17 of apparatus 1) and the terminal portion 102 positions inside the cooled structure 11 of the heat protected zone 4 described above. During heat treatment of the main portion 101 of the containers, i.e., while the heat treatment zone 4 is heated with hot air, the heat protected zone may be cooled with cooling liquid and/or cooling air active on the mentioned cooled structure 11 hosting the terminal portions of the containers.

During heat shrinking of the main portion 101 of each container, the main portion contracts and contacts the surface of the product forming a plastic skin on and around the same product and causing air to escape from the inside of the main portion via the intermediate portion 103 and out of the container 100 via aperture 102*a*. The one or more openings 6 are sized such that, during heating of the main portion 101 of each container, initially air inside the main portion expands the main portion (due to the resistance to air passage offered by the intermediate and terminal portions of each container positioned in the opening 6 and optionally between belts 17); then heat shrinking generates contracting forces on the film of the main portions 101 causing each main portion to contract and contact the surface of the product forming a plastic skin on and around the same product, and also causing air to escape from the inside of the main portion via the intermediate portion and out of the container.

It should be noted that according to a currently preferred option, during heat shrinking of the main portion 101 of each container, no vacuum is applied at the terminal portion 102 or at the aperture 102*a* of each container: in other words gas is evacuated from the main portion 101 of each container solely by effect of heat shrinking of the same main portion pushing gas out of said aperture 102 and with no need of a positive action by a vacuum chamber, or similar vacuum apparatus, operative on the aperture 102*a* of the terminal portions 102.

In the example shown in the attached figures, the intermediate portion 103 of each container is also captured between the mutually opposed rectilinear stretches 17*a* the described pair of belts 17, which contact the surface of the intermediate portion of each container and compress it without however causing a total occlusion to gas exiting from the main portion of each container via said intermediate portion. The belts may in practice aid in precisely controlling the position of the terminal portions of the processed containers also aiding in driving the containers from the inlet to the outlet, while leaving escape channels 19*a* open to gas evacuation.

The process and the apparatus 1 above described thus allow an efficient gas evacuation from the main portion of the processed packages and also a stretching of the film at the main portion with a consequent positive aesthetical effect as the main portion of the package copies as a skin the contained product an yet remains free or substantially free of wrinkles. Furthermore, as the terminal portion is not heat treated there is no risk of sticking of the internal surfaces of the terminal portion and thus gas can reliably evacuate during the entire process with no need of applying vacuum from the outside of the package.

Heat Shrink Device 30 for Heat Treating Terminal Portions 102 of Containers 100

Figure 8:
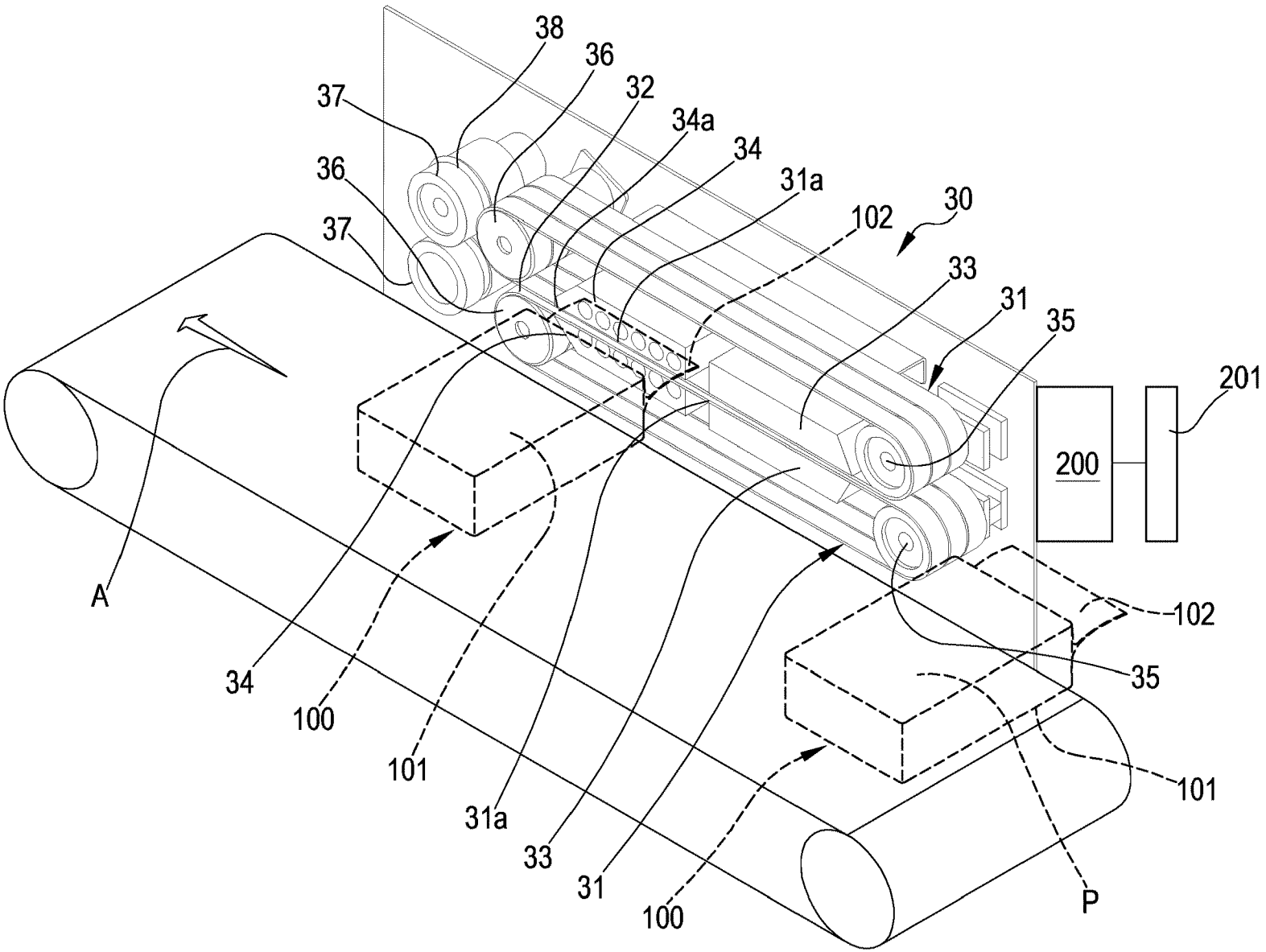
FIG. 8 is a schematic perspective view of a heat shrink device which is part of the packaging line of FIG. 1 and in the packaging line of FIG. 2.

Another aspect of the invention concerns a heat shrink device 30, shown in detail in FIG. 8, for processing the above described containers 100 and adapted for heat treatment and specifically for heat shrinking the terminal portions 102 not occupied by product of said containers 100. The device 30 may be for example used together with the apparatus 1 described above and specifically may operate on containers which have already been processed by apparatus 1 to heat shrink the terminal portion 102 of the containers, which as above discussed is not heat treated by the apparatus 1.

As shown in FIG. 8, the device 30 comprises a pair of opposed shrink belts 31: each shrink belt 31 has an operative stretch 31*a* facing a corresponding operative stretch of the opposite shrink belt and forming a gap 32. More precisely, the operative stretches 31*a* have respective external surfaces, which are opposite to each other and define therebetween the mentioned gap 32. The gap extends all along the mutually facing stretches 31*a* of the belts and is configured for receiving the terminal portion 102 of each container 100 to be processed.

A belt heater 33 is associated to at least one of said shrink belts. In a currently preferred option a belt heater 33 is associated to each shrink belt 31. Each belt heater 33 s configured for bringing the external surface of the operative stretch 31*a* of the respective belt 31 at least at a shrink temperature sufficient to cause heat shrinking of the film forming the terminal portion of the processed packages. In accordance with an aspect, each belt heater 33 is configured for bringing the external surface of the operative stretch of the respective belt at a shrink temperature comprised between 130° and 180° C., such that the terminal portion of each processed container passing through said gap is heat shrunk.

The heat shrink device 30 further comprises a flattening body 34 associated to one or both shrink belts 31 and configured for maintaining flat at least a portion of said external surfaces of the flat stretches. The flattening body 34 may be a body in a conductive material, such as a metal and in particular Aluminum, and is positioned downstream the belt heater 33 associated to the same belt 31, with respect to a direction of movement A imparted by the opposed shrink belts to the processed containers. Each flattening body 34 has a flat active surface 34*a* acting on the respective operative stretch 31*a* of the corresponding shrink belt 31.

As shown in the figures, each one of operative stretches 31*a* is a rectilinear stretch having a respective external surface which is a flat surface and the gap 32 is, in an option, a constant thickness planar gap: the thickness of the gap may be comprised between 0.1 mm and 2.0 mm, optionally between 0.3 mm and 1.0 mm.

Going in further detail, each shrink belt 31 is an endless belt engaged between at least a respective driving pulley 35 and a respective driven pulley 36: each shrink belt 31 is particularly large in width and specifically the width of each shrink belt is comprised between 20 mm and 60 mm, optionally between 30 mm and 50 mm thereby being able to efficiently heat treat terminal portions of relatively big size.

The heater 33 associated to each shrink belt is housed inside a loop defined by each respective endless shrink belt 31 and configured for heating by direct contact an inside surface of the respective shrink belt and in particular the inside surface of the operative stretch of the respective shrink belt. On its turn, the flattening body 34 associated to each shrink belt is also housed inside a loop defined by each respective endless belt and configured for directly contacting an inside surface of the respective shrink belt.

The heat shrink device 30 may also comprise a pair of rollers 37 operative downstream the opposed shrink belts 31 with respect to a direction of movement A imparted by the opposed shrink belts to the processed containers 100: the pair of rollers 37 cooperate to define a nip therebetween for receiving the terminal portion 102 of each processed container and for further squeezing the terminal portions of the processed containers reducing as possible any wrinkles.

Finally the device 30 may include a sealer 38 configured to form a heat sealing band on the terminal portion of each processed bag thereby hermetically sealing each processed container. The sealer 38 may be separate from the described components (belts and rollers) or it may be associated to one or rollers, for example in the form of a heated circumferential feature on the external surface of one or both the rollers 37 (see FIG. 8), or to one of the opposed belts optionally in the form of a heated feature on the external surface of one or both the opposed shrink belts. The heated feature on the roller or on the shrink belt may be independently heated to reach a temperature adequate to cause formation of a seal band across the terminal portions of the processed packages. The above components of the device 30, namely the belts and related driving pulleys, the heaters, and the rollers, as well as the sealer, if present, may be controlled by control unit 200 or by a dedicated controller of device 30.

Process of Heat Treating Terminal Portions 102 of Containers 100 Using Heat Shrink Device 30

A further aspect of the invention concerns a process of heat shrinking a selected portion of above described containers and specifically the terminal portion 102 not occupied by product. The process of heat treatment of the terminal portion 102 of said containers may be executed using the heat shrink device 30 described above and comprises heat shrinking the terminal portion 102 of each container: in particular, during heat shrinking of the terminal portion 102 of the processed containers 100, the main portion 101 of the same containers is not heat shrunk or in any case is heat shrunk significantly less than the terminal portion.

In accordance with this process, the terminal portion 102 of each processed container is inserted into said gap 32 defined by said shrink belts 31 of the heat shrink device 30 (FIG. 8) and heat shrunk while travelling within said gap. At this purpose, each respective belt heater 33 associated to each shrink belt is operated for bringing said external surfaces of both the operative stretches 31*a* at least at a shrink temperature comprised between 130° and 180° C., such that the terminal portion 102 of each processed container passing through said gap 32 is also brought to said shrink temperature and thus heat shrunk.

In accordance with an aspect, the terminal portion 102 of each container, while travelling through the gap 32 between the two shrink belts of device 30 is put in contact with and flattened by the external surfaces of the flat stretches 31*a*, also thanks to the action on the belts of flattening bodies 34. The process may also provide a step of squeezing the terminal portion of each processed container between the above described pair of rollers 37 operative downstream the opposed shrink belts 31.

The process may also provide for forming with said shrink belts a heat sealing band on the terminal portion of each processed container thereby hermetically sealing each processed container. Alternatively or in addition the process may provide for forming with said pair of rollers a heat sealing band or a further heat sealing band on the terminal portion of each processed bag thereby hermetically sealing each processed container.

During the above described process and while the terminal portion of each container is brought above the shrink temperature causing heat shrinking of the same terminal portion, the main portion of each container is maintained at a temperature below the shrink temperature, optionally at a temperature at least 30° C. below said shrink temperature, more optionally at a temperature at least 50° below the shrink temperature. For example the terminal portion of each container may be brought at a temperature above 130° C., optionally between 130° and 180° C., while the respective main portion is maintained at a temperature below 100° C., in particular below 90° C.

Finally, in accordance with a further aspect the process may provide (typically at the beginning of the process) for a step of adjusting the size of said gap 32 before processing said containers in order to adapt the gap to the thickness of the film of the containers being processed.

Packaging Line 50 for Making Closed and Heat Shrunk Packages.

Figure 2:
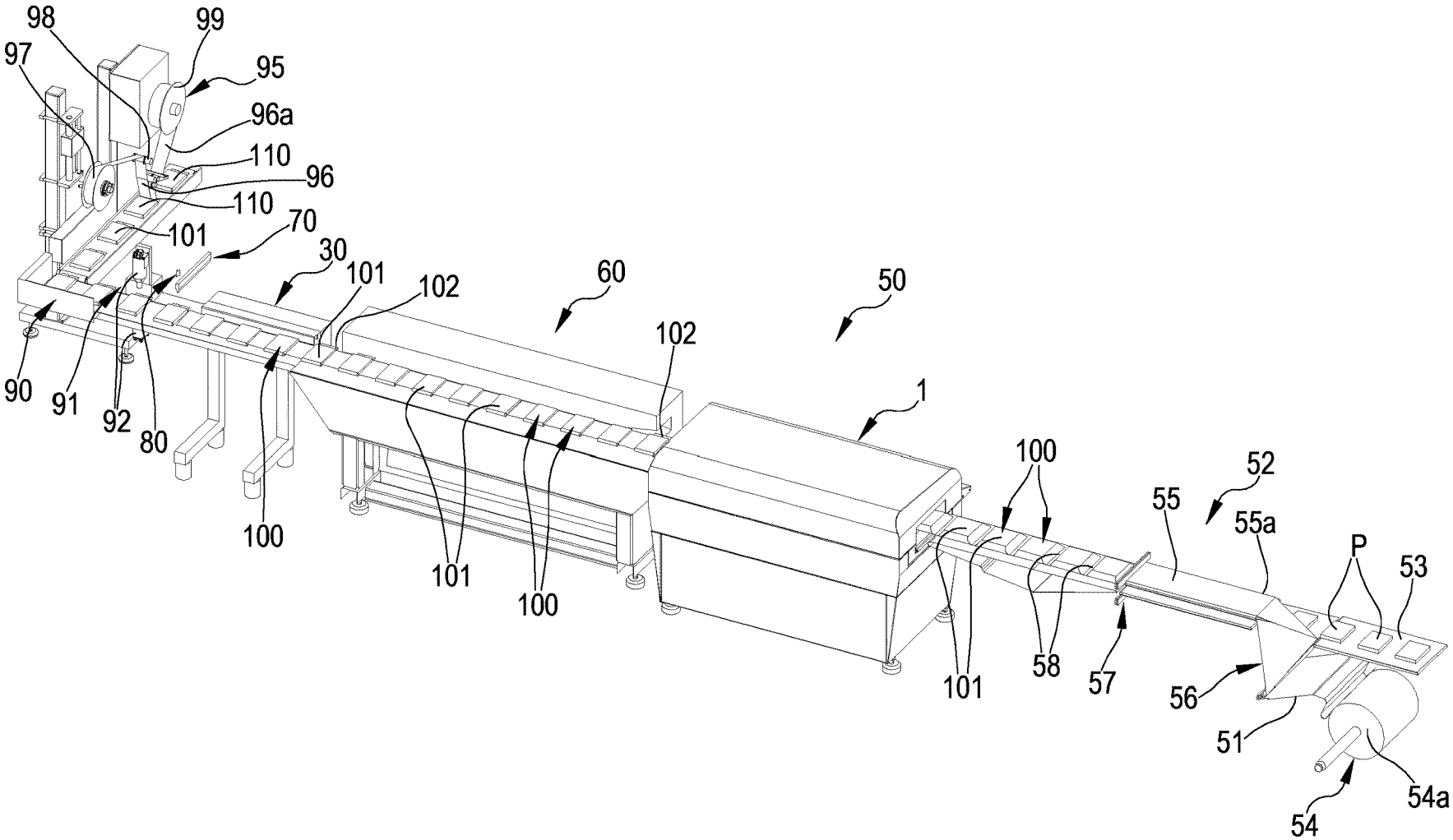
FIG. 2 is a schematic perspective view of a second packaging line according to aspects of the invention.

In FIGS. 1 and 2 a respective packaging line 50 according to a first and a second example is shown. Each packaging line 50 is destined to form a closed and heat shrunk package 110 starting from a heat shrinkable film 51. The formed packages 110 may be bags or pouches and in particular may be made from heat shrinkable plastic film showing a free shrinking value at 120° C. (value measured in accordance with ASTM D2732, in oil) in the range from 2% to 80% in both longitudinal and transverse directions, optionally in the range from 5% to 60% in both longitudinal and transverse directions, more optionally in the range from 10% to 40% in both longitudinal and transverse directions.

The packaging line 50 of FIGS. 1 and 2 comprise a loader 52 of the containers 100: as already discussed, the containers have a main portion 101 where a product P is housed, a terminal portion 102 having at least one aperture allowing gas evacuation from the container, and an intermediate portion 103 connecting the main portion and the terminal portion. The line 50 comprises the heat shrink apparatus 30 described above positioned immediately downstream the loader 52; the loader is configured to supply said containers 100 to the heat shrink apparatus 30, which is configured to heat shrink the main portion 101 of each container, as explained above.

Note that the loader 52 is configured to supply said containers 100 to the heat shrink apparatus either in form of interconnected containers (as shown in FIGS. 1 and 2) or in form of a sequence of separated containers.

In detail, the loader 52 of the line of FIGS. 1 and 2 comprises a conveyor 53 configured for advancing products P to be packaged along an operating path, and a film supply 54 configured for supplying heat shrinkable plastic film 51 along the operating path and for positioning the film 51 around the products P forming an almost tubular structure 55 housing the products P to be packaged. The almost tubular structure 55 may be substantially C or U or V shaped in cross section and in any case forms a longitudinal aperture 55*a* delimited by opposite longitudinal borders of the film 51. In order to obtain the almost tubular structure 55 film 51 may supplied in the form of a flat film from a film supply 54 comprising a feed roll 54*a*. The flat film 51 is bent on itself by a film former or bending device 56 to confer to the film the desired almost tubular shape. Of course, nothing excludes that the film be directly supplied in the almost tubular form from an extruder or from other film supplying device or that the film is supplied in tubular form and then opened along a longitudinal line to form an almost tubular film structure.

The loader 52 also includes a transverse sealer 57 configured for forming seal bands 58 transversal to the almost tubular structure 55 forming a plurality of the above described containers 100, each of said containers hosting a respective product at the main portion 101 and having a terminal portion 102 with an aperture, such as with an open end. As mentioned the containers 100 may be severed from each other or, as it is currently preferred, supplied as a chain of interconnected open containers to the heat shrink apparatus 1 described above. Once the heat shrink apparatus has taken care of heat shrinking the main portion 101 of the processed containers 100, the containers exiting from the apparatus 1 may be treated by the heat shrink device 30, which is also part of the lines of FIGS. 1 and 2.

In the alternative of FIG. 1, the containers 100 with the main portion 101 heat shrunk exiting from apparatus 1 directly reach the heat shrink device 30, which is positioned immediately downstream of the heat shrink apparatus 1 and is configured to receive said containers 100 with heat shrunk main portions 101 and to heat shrink the terminal portions 102 of each processed container.

In accordance with a possible variant the heat shrink device 30 may also be configured to form a heat seal band across the terminal portion of each processed container (for example perpendicular to seal bands 58) to hermetically close said aperture 102*a* and form closed packages.

In the variant of FIG. 2, the packaging line 50 comprises a vacuum station 60 configured for receiving the terminal portions 102 of the processed containers and to suck gas from each container via said aperture 102*a*.

In greater detail, the vacuum station 60 of the line of FIG. 2 is positioned immediately downstream of the heat shrink apparatus 1 and is configured to receive containers 100 with heat shrunk main portions 101 coming from the heat shrink apparatus 1.

The vacuum station 60 applies to the terminal portions 102 of the processed containers a pressure inferior to the pressure present inside the main portions, thereby sucking gas from each container 100 via said aperture 102*a* and vacuumizing the containers 100.

Figure 7:
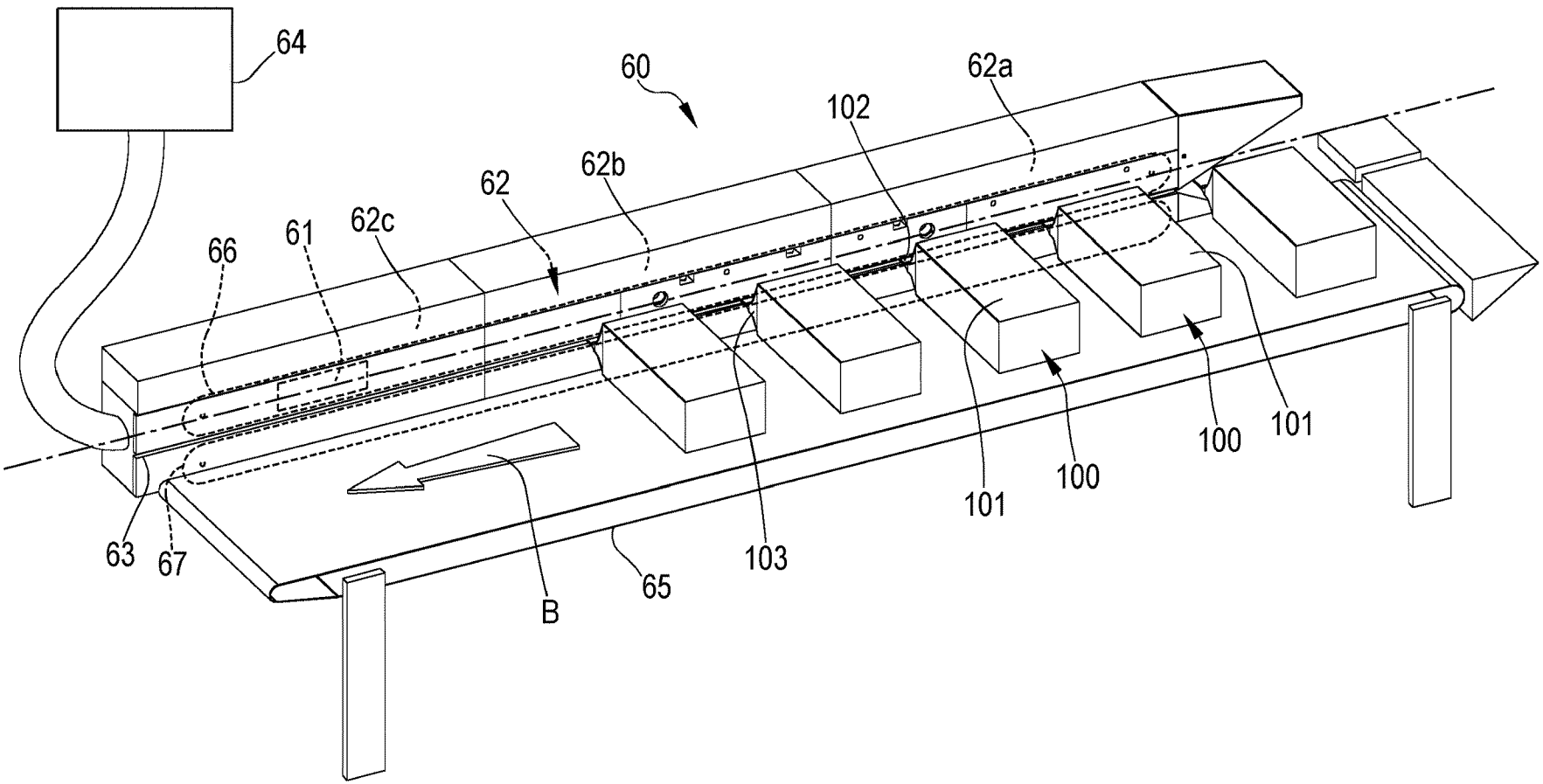
FIG. 7 is a schematic perspective view of a vacuum station operative in the packaging line of FIG. 2, downstream the apparatus of FIG. 3.

Going into greater detail, and referring to FIGS. 2 and 7, the vacuum station 60 of the line of FIG. 2 is operatively positioned between the heat shrink apparatus 1 and the heat shrink device 30 and is configured to deliver to the heat shrink device 30 vacuumized containers having heat shrunk and vacuumized main portions. The device 30 then threats these containers 100 and heat shrinks the terminal portions 102 thereof as described above.

Note also the vacuum station 60 may include a own heat sealer 61, for example comprising heat sealing belts or heat sealing wheels or other heat sealing devices, configured to form a heat seal band across the terminal portion of each processed container to hermetically close said aperture and form closed, and vacuumized, packages.

As shown in FIG. 7, the vacuum station 60 of the example herein disclosed comprises an elongated vacuum chamber 62 having an elongated opening 63 extending along the vacuum chamber, a vacuum source 64 configured for providing the vacuum chamber 62 with an internal vacuum pressure that is lower than an ambient pressure outside the vacuum chamber, and a conveyor 65 supporting the main portion of the processed containers 100.

In practice the conveyor 65 may be a conveyor belt or other type of conveyor and is configured for moving the processed containers 100 relative to the vacuum chamber, as shown by arrow B: the containers to be evacuated are positioned so that, during the relative movement of the each container 100 with respect to the vacuum chamber 62, the terminal portion 102 of each container relatively moves within the vacuum chamber 62 and the main portion 101 of each container relatively moves outside the vacuum chamber (and lies on the conveyor 65), with the intermediate portion 103 of each processed container passing through and relatively moving along the elongated opening 63.

In order to aid in driving and precisely positioning the terminal portion of each container, the vacuum station may comprise a first guide belt arranged along a length of the elongated opening 63 and configured with an outer surface contacting the terminal portion of each processed container: the outer surface of the first guide belt 66 is optionally provided with a contoured shape comprising recesses. The vacuum station has also a second guide belt 67 arranged along said length of the elongated opening 63, opposed to the first guide belt 66 and configured with a respective outer surface contacting the terminal portion of each processed container: also the outer surface of the first guide belt may optionally be provided with a contoured shape comprising recesses. The first and second drive belts 66, 67 are endless belts and their motion is controlled by control unit 200 or by an further controller of the line 50 and is synchronized with the motion of the conveyor 65 supporting the containers main portions.

In accordance with another aspect, the vacuum chamber 62 may include at least a first sub-chamber 62*a* and a second sub-chamber 62*b* (a third or more other sub-chambers 62 *c* may be provided): in this case the vacuum station 60 may be configured to provide the first sub-chamber 62*a* with a first pressure (in general lower than atmospheric pressure present outside the vacuum station) and to provide the second sub-chamber 62*b* with a second pressure different from, optionally lower than, the first pressure, to improve as possible flexibility of the vacuum station and ability to extract gas from the processed containers.

Note that in addition or in alternative to sealer 61 a separate sealing station configured for heat sealing the terminal portions of each container (for example by forming one or more seal bands transversal to the terminal portions) and thus form closed packages may be positioned downstream the vacuum station or downstream the device 30 in case the vacuum station and the device 30 are deprived of a own sealer.

The lines of FIGS. 1 and 2 may also comprise a cutting station 70 (see also FIG. 9) configured for transversely severing the interconnected containers 100 and form a plurality of separated containers: the cutting station 70 is operative either immediately downstream the heat shrink apparatus 1 or immediately downstream the vacuum station 60 (if present) or, in a currently preferred option, downstream the heat shrink device 30 (see FIGS. 1 and 2).

In accordance with a further aspect, the lines of FIGS. 1 and 2 may also comprise a forming station 80 (schematically represented in FIGS. 1, 2 and 9) configured for forming an easy opening feature: the easy opening feature may be a cut or notch or a weakening line formed at one of the peripheral borders of each processed container 100, for example formed at the terminal portion 102 of each container. The forming station 80 is operative either immediately downstream the heat shrink apparatus 1 or immediately downstream the vacuum station 60 (if present) or, in a currently preferred option, downstream the heat shrink device 30, for example before or after or even at the cutting station 70.

Figure 9:
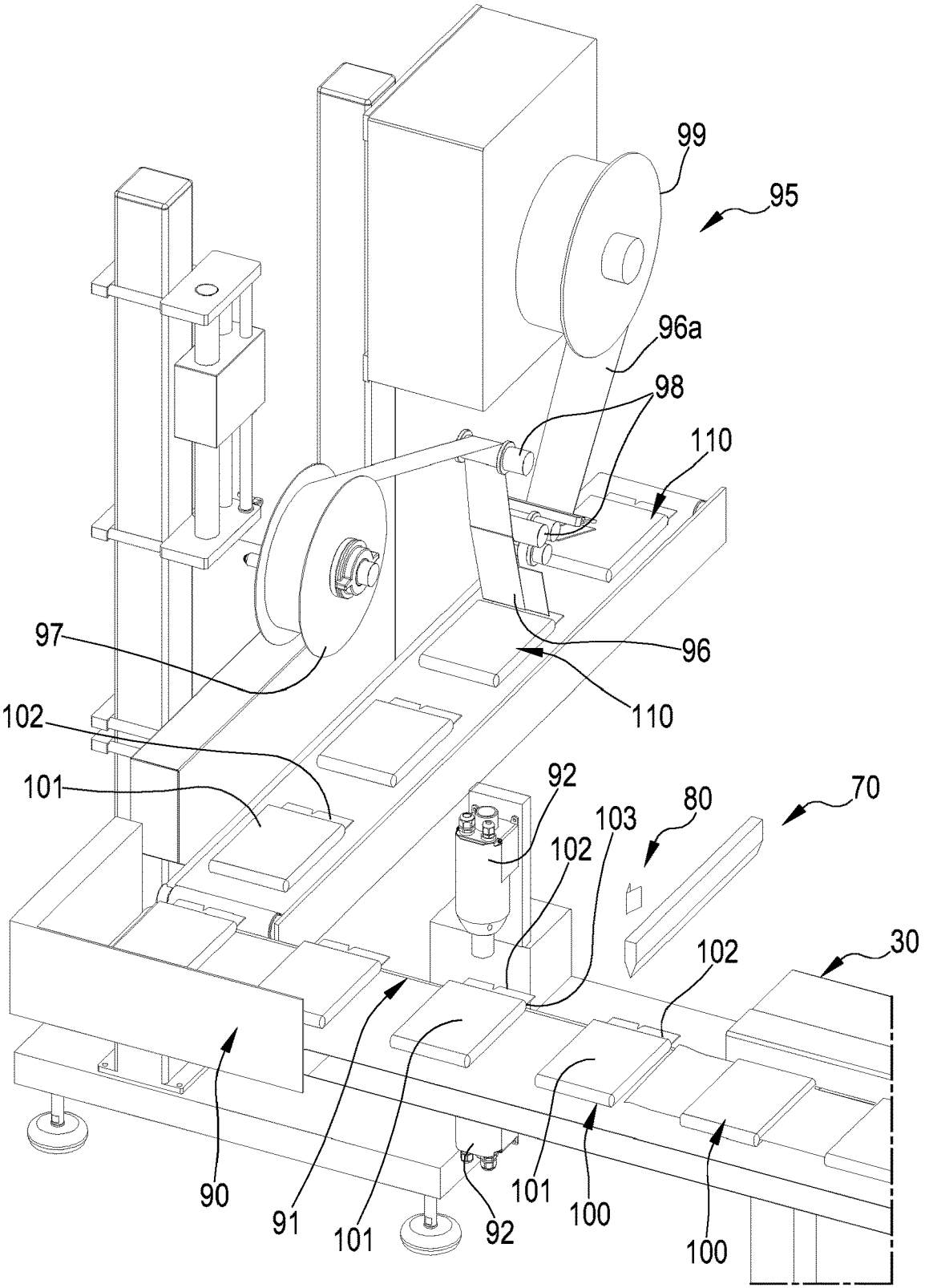
FIG. 9 is a schematic perspective view showing further operative stations, which may be present in the packaging line of FIG. 1 and in the packaging line of FIG. 2.

As shown in FIGS. 1, 2 and 9, the packaging line 50 may also include a redirecting station 90 configured to orient each processed container 100 such that its terminal portion 102 is oriented towards a direction of motion of the container downstream the same redirecting station: in the examples shown the redirecting station 90 directs the containers transversally with respect to the operating path the containers had upstream the redirecting station 90. The redirecting station 90 is operative, in a currently preferred option, downstream the heat shrink device 30 and in particular downstream the cutting station 70 in order to act on containers which are no longer interconnected.

In the examples shown, the packaging line 50 comprises also a heat shrink finisher 91 operative downstream the heat shrink apparatus 1, in particular downstream the heat shrink device 30. The heat shrink finisher 91 may for example be located immediately upstream the re-directing station 90 (if present). The heat shrink finisher 91 is configured to direct hot air, optionally hot air at a temperature comprised between 130 and 180° C., at least towards the intermediate portion 103 of each processed container to basically heat shrink also the intermediate portion which may have not been properly shrunk at the preceding stations. The heat shrink finisher 91 optionally comprises two opposite hot air blowers 92 configured for acting on opposite sides of the intermediate portion of each processed container: the two air blowers are independently controlled, for example by control unit 200, and are able to control bending of the terminal portion of each processed container.

Finally, the lines of FIGS. 1 and 2 may also comprise a labelling station 95 configured for applying at least one label 96 to each processed container: in particular, the labelling station 95 may be adapted to apply a label 96 to the terminal portion of each processed container; the labelling station 95 is operative downstream the heat shrink apparatus 1, in particular downstream the heat shrink device 30 and, if present, downstream the redirecting station 90. The labelling station includes a label feed roll 97, guide rollers or other guide means 98 configured for driving and positioning the adhesive label 96 on the portion of interest of each container arriving at the labeling station, and a waste roll 99 for receiving the support layer 96*a* which carried the applied label 96.

Packaging Process for Making Closed and Heat Shrunk Packages Using Packaging Line 50.

A further aspect of the invention concerns a packaging process using the line 50 described above for example the packaging line of FIG. 1 or the packaging line of FIG. 2.

The process provides for forming or receiving a plurality of containers 100 of the type described above, namely made from heat shrinkable plastic film and having a main portion 101 where a product P is housed, a terminal portion 102 having at least one aperture 102*a* allowing gas evacuation from the container, and an intermediate portion 103 connecting the main portion and the terminal portion.

In an alternative, preformed containers 100 of the type described above either interconnected or separated from each other may be supplied directly to the heat shrink apparatus 1.

In another alternative, which is represented in FIGS. 1 and 2, the process provides for inline forming the containers 100. The forming of the containers may take place at the loader 52 described above and may include:

- advancing a heat shrinkable plastic film 51 along an operating path,
- advancing products P to be packaged along the operating path together with the plastic film, positioning the plastic film 51 around the products before formation of the containers 100, the plastic film being a continuous plastic film shaped into an almost tubular film structure 55 receiving the products P appropriately spaced from each other in a longitudinal direction of motion of the products on a conveyor 53;

forming on the almost tubular film structure 55 transversal heat seal bands 58, oriented transversally to a direction of advancement of the plastic film along the operating path, to form said plurality of containers 100, which are consecutively arranged (and in the example shown interconnected at bands 58).

The almost tubular structure 55 has a longitudinal aperture 55*a*, optionally a longitudinal side aperture, and the containers formed from the almost tubular structure are either in the form of interconnected containers or, if a severing sub step takes place, in the form of a sequence of separated containers.

Irrespective of how the open containers described above are obtained, the process then provides for executing on the containers a process of heat shrinking the main portion 101 of the containers using the heat shrink apparatus 1 and subsequently executing a process of heat shrinking the terminal portions 102 of the processed containers using the heat shrink device 30.

Once or while the terminal portions 102 of the containers are been heat shrunk, the process forms a heat seal band across the terminal portion of each processed container to hermetically close said aperture and form closed packages 110.

Note that closure of the containers with a sealer forming a heat seal band may also take place before heat shrinking the terminal portions or after vacuumization at vacuum station 60 when this latter is present (variant of FIG. 2).

In the variant of line shown in FIG. 2, the containers exiting from apparatus 1 and thus having their main portions 101 heat shrunk are treated at the vacuum station 60 described above where withdrawing of gas from each container 100 via said aperture 102*a* is obtained by applying a vacuum from outside each terminal portion 102.

As shown in FIG. 2, the steps of receiving the containers at the vacuum station 60 and withdrawing gas preferably take place after said main portion 101 of the containers housing the product P has been heat shrunk and before heat shrinking the terminal portion 102 of containers.

The vacuum station 60 applies to the terminal portions 102 of the processed containers a pressure inferior to the pressure present inside the main portions, thereby sucking gas from each container via said aperture and forming vacuumized containers having heat shrunk main portions.

The vacuum station 60 may be of the type described above in connection with the packaging line of FIG. 2. In an option, the vacuum station 60 may comprise a own heat sealer 61 forming a heat seal band across the terminal portion of each processed container to hermetically close said aperture and form closed packages.

The containers 100 or closed packages 110 exiting from the vacuum station 60 arrive at the shrink device 30 where the terminal portions are heat shrunk. Then, if the containers or closed packages are still interconnected they reach cutting station 70, which transversely severs the interconnected containers and forms a plurality of separated containers.

Subsequently or at the same time with cutting or before the cutting, a step of forming an easy opening feature (at forming station 80), optionally a cut or notch or a weakening line, at one of the peripheral borders of each processed container is provided: for example forming the easy opening feature may take place after said main portion of the containers housing the product has been heat shrunk, optionally after also said terminal portion of the containers has been heat shrunk.

In the examples show, the process implemented by the lines of FIGS. 1 and 2 also comprises a step of redirecting each processed container such that its terminal portion extends forward from the main portion towards a direction of motion of the container: in the examples shown redirecting takes place at redirecting station 90, after said terminal portion 102 of the containers has been heat shrunk and before labelling.

In accordance with one further aspect, the process may provide for a heat shrink finishing step, which takes place after said main portion 101 of the containers housing the product has been heat shrunk and after also said terminal portion 102 of the containers has been heat shrunk; the heat shrink finishing step (operated at finishing station 91) includes directing hot air, optionally hot air at a temperature comprised between 130 and 180° C., at least towards the intermediate portion of each processed container. In detail, the heat shrink finishing step may use two opposite hot air blowers 92 acting on opposite sides of the terminal portion of each processed container: the two air blowers are independently controlled and, by piloting the respective hot air jets in a differentiated manner, cause a controlled bending of the terminal portion 102 of each processed container or closed package.

Finally, the process may provide for applying at least one label 96 (at labelling station 95) to each processed container or package, in particular to the terminal portion of each processed closed package; labelling takes place after said terminal portion of the containers has been heat shrunk.

The above described lines and processes allow to obtain a gas tightly closed package (for example a gas tightly closed bag) with reduced content of gas, improved aesthetic properties due to the substantial absence of wrinkles on the main portion of the package, and with reduced use of film material.

Although in FIGS. 1 and 2 the line 50 and the related packaging process use both the apparatus 1 and the device 30 it is not excluded to have a line without the apparatus 1 or without the device 30: for example the line of FIG. 1 may be deprived of one of the apparatus 1 or the device 30, and the line of FIG. 2 may be deprived of one of the apparatus 1 or the device 30, thus only heat shrinking a portion of the containers.

The invention claimed is:

1. A heat shrink device for processing containers that include heat shrinkable plastic film, the containers each having a main portion in which a product is housed, a terminal portion that is not occupied by the product, and an intermediate portion connecting the main portion and the terminal portion, wherein the device comprises:

first and second shrink belts that are opposed to each other, wherein the first shrink belt has a first operative stretch facing a second operative stretch of the second shrink belt, wherein the first and second operative stretches have external surfaces defining a gap therebetween, wherein the gap is configured to receive the terminal portion of each container to be processed;

a first belt heater associated with the first shrink belt, the first belt heater configured to bring the external surface of the first operative stretch at least to a shrink temperature such that the terminal portion of each processed container passing through the gap is heat shrunk;

a sealer configured to form a heat sealing band on the terminal portion of each processed container thereby sealing each processed container; and a pair of rollers located downstream of the first and second shrink belts with respect to a direction of movement imparted by the first and second shrink belts to the processed containers, wherein the pair of rollers define a nip therebetween for receiving the terminal portion of each processed container;

wherein the sealer includes a heated circumferential feature on an external surface of one of the pair of rollers.

2. The heat shrink device of claim 1, further comprising a second belt heater associated with the second shrink belt, the second heat belt heater configured to bring the external surface of the second operative stretch at least to the shrink temperature such that the terminal portion of each processed container passing through said gap is heat shrunk.

3. The heat shrink device of claim 2, further comprising first and second flattening bodies respectively associated with the first and second shrink belts, the first and second flattening bodies configured to maintain flat at least a portion of the external surfaces.

4. The heat shrink device of claim 3, wherein the first flattening body is positioned downstream of the first belt heater with respect to the direction of movement imparted by the first and second shrink belts to the processed containers, and wherein the second flattening body is positioned downstream of the second belt heater with respect to the direction of movement.

5. The heat shrink device of claim 1, wherein the gap is a planar gap having a constant thickness.

6. The heat shrink device of claim 1, wherein a thickness of the gap is in a range between 0.1 mm and 2.0 mm.

7. The heat shrink device of claim 1, wherein a thickness of the gap is in a range between 0.3 mm and 1.0 mm.

8. The heat shrink device of claim 1, wherein a width of each of the first and second shrink belts is in a range between 20 mm and 60 mm.

9. The heat shrink device of claim 1, wherein a width of each of the first and second shrink belts is in a range between 30 mm and 50 mm.

10. The heat shrink device of claim 1, wherein the first belt heater is housed inside a loop defined by the first shrink belt and the first belt heater is configured to heat an inside surface of the first shrink belt.

11. The heat shrink device of claim 10, wherein the first belt heater is configured to heat the inside surface of the first shrink belt by direct contact with the inside surface of the first operative stretch of the first shrink belt.

12. The heat shrink device of claim 1, wherein the containers are bags or pouches made from the heat shrinkable plastic film, wherein the heat shrinkable plastic film has a free shrinking value at 120° C., measured in accordance with ASTM D2732 in oil, in a range from 2% to 80% in both longitudinal and transverse directions.

13. The heat shrink device of claim 1, wherein the containers are bags or pouches made from the heat shrinkable plastic film, wherein the heat shrinkable plastic film has a free shrinking value at 120° C., measured in accordance with ASTM D2732 in oil, in a range from 5% to 60% in both longitudinal and transverse directions.

14. The heat shrink device of claim 1, wherein the containers are bags or pouches made from the heat shrinkable plastic film, wherein the heat shrinkable plastic film has a free shrinking value at 120° C., measured in accordance with ASTM D2732 in oil, in a range from 10% to 40% in both longitudinal and transverse directions.

15. The heat shrink device of claim 1, wherein the shrink temperature is in a range between 130° C. and 180° C.

16. A heat shrink device for processing containers that include heat shrinkable plastic film, the containers each having a main portion in which a product is housed, a terminal portion that is not occupied by the product, and an intermediate portion connecting the main portion and the terminal portion, wherein the device comprises:

first and second shrink belts that are opposed to each other, wherein the first shrink belt has a first operative stretch facing a second operative stretch of the second shrink belt, wherein the first and second operative stretches have external surfaces defining a gap therebetween, wherein the gap is configured to receive the terminal portion of each container to be processed a first belt heater associated with the first shrink belt, the first belt heater configured to bring the external surface of the first operative stretch at least to a shrink temperature such that the terminal portion of each processed container passing through the gap is heat shrunk;

a sealer configured to form a heat sealing band on the terminal portion of each processed container thereby sealing each processed container; and a pair of rollers located downstream of the first and second shrink belts with respect to a direction of movement imparted by the first and second shrink belts to the processed containers, wherein the pair of rollers define a nip therebetween for receiving the terminal portion of each processed container;

wherein the sealer includes a heated feature on an external surface of one of the first and second shrink belts.

17. The heat shrink device of claim 16, further comprising a second belt heater associated with the second shrink belt, the second belt heater configured to bring the external surface of the second operative stretch at least to the shrink temperature such that the terminal portion of each processed container passing through said gap is heat shrunk.

18. The heat shrink device of claim 17, further comprising first and second flattening bodies respectively associated with the first and second shrink belts, the first and second flattening bodies configured to maintain flat at least a portion of the external surfaces.

19. The heat shrink device of claim 18, wherein the first flattening body is positioned downstream of the first belt heater with respect to the direction of movement imparted by the first and second shrink belts to the processed containers, and wherein the second flattening body is positioned downstream of the second belt heater with respect to the direction of movement.

20. The heat shrink device of claim 16, wherein the gap is a planar gap having a constant thickness.

* * * * *